US010780313B2

(12) United States Patent
Pinkart

(10) Patent No.: US 10,780,313 B2
(45) Date of Patent: Sep. 22, 2020

(54) EXERCISE STICK

(71) Applicant: Patrick Pinkart, Los Osos, CA (US)

(72) Inventor: Patrick Pinkart, Los Osos, CA (US)

( * ) Notice: Subject to any disclaimer, the term of this patent is extended or adjusted under 35 U.S.C. 154(b) by 36 days.

(21) Appl. No.: 16/271,238

(22) Filed: Feb. 8, 2019

(65) Prior Publication Data

US 2020/0121978 A1 Apr. 23, 2020

Related U.S. Application Data

(63) Continuation-in-part of application No. 16/162,538, filed on Oct. 17, 2018, now Pat. No. 10,632,338.

(51) Int. Cl.
*A63B 21/00* (2006.01)
*A63B 21/16* (2006.01)

(52) U.S. Cl.
CPC ..... *A63B 21/4035* (2015.10); *A63B 21/1663* (2013.01); *A63B 21/4043* (2015.10)

(58) Field of Classification Search
CPC ..... A63B 21/4035; A63B 21/055; A63B 21/00072; A63B 21/00058;
(Continued)

(56) References Cited

U.S. PATENT DOCUMENTS 3,811,672 A * 5/1974 Simmons ..... A63B 21/012 482/114
4,529,194 A * 7/1985 Haaheim ..... A63B 21/012 482/70

(Continued)

*Primary Examiner* — Jennifer Robertson
*Assistant Examiner* — Kathleen Vermillera

(74) *Attorney, Agent, or Firm* — The Iwashko Law Firm, PLLC; Lev Ivan Gabriel Iwashko

(57) ABSTRACT

An exercise stick, including a main pole, and a tensioning assembly disposed at a substantially center portion of the main pole to move up the main pole in a first direction toward a first end of the main pole, and to move down the main pole in a second direction toward a second end of the main pole, the tensioning assembly including a large gear disposed on the tensioning assembly to change a resistance between the tensioning assembly and the main pole in response to a rotation of the large gear, and a plurality of tension clamps connected to opposing sides of the large gear to expand and contract in response to the rotation of the large gear. The tensioning assembly may further include a first worm gear to contact one of the plurality of tension clamps, and a second worm gear to contact another one of the plurality of tension clamps, such that the rotation of the large gear causes the first worm gear and the second worm gear to turn to expand or contract the plurality of tension clamps. The resistance between the tensioning assembly and the main pole may increase or decrease based on a tightening of the first worm gear and the second worm gear within the tensioning assembly, to cause the tensioning assembly to move more easily along the main pole based on a loosening of the first worm gear and the second worm gear or more difficultly along the main pole based on a tightening of the first worm gear and the second worm gear. The tensioning assembly may further include a first tension clamp having a first small gear connected to a first worm gear, the first tension clamp disposed within an inner portion of the tensioning assembly to grip a portion of the main pole, such that two upper surfaces of the first tension clamp opens or closes in response to a rotation of the first small gear, and a second tension clamp having a second small gear connected to a second worm gear, the second tension clamp disposed within the inner portion of the tensioning assembly to grip a portion of the main pole, such that two upper surfaces of the second tension clamp opens or closes in response to a rotation of the second small gear, such that the large gear is rotatably connected to the first small gear and the second small gear to control the rotation of the first small gear and (Continued)

the second small gear. The exercise stick may further include a handle assembly attached to the tensioning assembly to allow a user to move the tensioning assembly in the first direction and the second direction. The handle assembly may include a handle foot to attach to the tensioning assembly. The tensioning assembly may further include a handle lock disposed within a central portion of a rear surface to receive the handle foot. The handle lock may include a handle lock lever disposed within a top portion of the tensioning assembly to lock or unlock the handle foot within the handle lock, and a rotatable locking member disposed within a central portion of the handle lock to rotate in response to a manipulation of the handle lock lever, such that the handle foot is removable in the unlocked position and not removable in the locked position.

7 Claims, 23 Drawing Sheets

(58) Field of Classification Search
CPC ..... A63B 21/00069; A63B 21/00189; A63B 21/02; A63B 21/0407; A63B 21/0428; A63B 21/0442; A63B 21/0552; A63B 21/0557; A63B 21/16; A63B 21/1618; A63B 21/1627; A63B 21/1636; A63B 21/1645; A63B 21/1654; A63B 21/1663; A63B 23/0211; A63B 2208/0204; A63B 2210/50; A63B 21/4043; A63B 2244/22–225; B60R 2011/0085; F16M 2200/024; B60N 2/165; B60N 2/166; A61H 1/00; A61H 1/02; A61H 1/0237–0285
USPC ..... 248/292.12, 422
See application file for complete search history.

(56) References Cited

U.S. PATENT DOCUMENTS 4,603,856 A * 8/1986 Fiore ..... A63B 21/015 482/114
2019/0009137 A1* 1/2019 Trevino ..... A63B 23/0211

* cited by examiner

EXERCISE STICK

CROSS REFERENCE TO RELATED APPLICATION

This application is a continuation-in-part of U.S. nonprovisional patent application Ser. No. 16/162,538, entitled "Exercise Stick," which was filed on Oct. 17, 2018.

BACKGROUND

1. Field

The present general inventive concept relates generally to an exercise device, and particularly, to an exercise stick that is portable and effective for strength-training and stretching.

2. Description of the Related Art

There is a plethora of scientific studies available that describe physical, psychological, as well as immune-enhancing benefits of resistive exercise. It is important for individuals to maintain an exercise regimen to keep muscles, connective tissue, and bones strong, which are essential to good, long-term health. However, most exercise equipment is bulky, heavy, and non-portable.

Also, people who are disabled often seek exercise devices that are light-weight, portable, and non-bulky. However, it is difficult to find such devices that also provide ample strength-training functionality.

Therefore, there is a need for effective strength-training equipment that is light-weight, easy to use and transport, can be used in the home or virtually anywhere desired, and requires no weights, springs or bands.

SUMMARY

The present general inventive concept provides a pole for use as a physical therapy or exercise tool with a sliding handle where an angle and a tension of the handle are adjustable.

The pole may further include a pair of foot straps and a door mount strap to stabilize the pole for exercises in a vertical, horizontal, or angular way.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an exercise stick, including a main pole, and a tensioning assembly disposed at a substantially center portion of the main pole to move up the main pole in a first direction toward a first end of the main pole, and to move down the main pole in a second direction toward a second end of the main pole, the tensioning assembly including a large gear disposed on the tensioning assembly to change a resistance between the tensioning assembly and the main pole in response to a rotation of the large gear, and a plurality of tension clamps connected to opposing sides of the large gear to expand and contract in response to the rotation of the large gear.

The tensioning assembly may further include a first worm gear to contact one of the plurality of tension clamps, and a second worm gear to contact another one of the plurality of tension clamps, such that the rotation of the large gear causes the first worm gear and the second worm gear to turn to expand or contract the plurality of tension clamps.

The resistance between the tensioning assembly and the main pole may increase or decrease based on a tightening of the first worm gear and the second worm gear within the tensioning assembly, to cause the tensioning assembly to move more easily along the main pole based on a loosening of the first worm gear and the second worm gear or more difficultly along the main pole based on a tightening of the first worm gear and the second worm gear.

The tensioning assembly may further include a first tension clamp having a first small gear connected to a first worm gear, the first tension clamp disposed within an inner portion of the tensioning assembly to grip a portion of the main pole, such that two upper surfaces of the first tension clamp opens or closes in response to a rotation of the first small gear, and a second tension clamp having a second small gear connected to a second worm gear, the second tension clamp disposed within the inner portion of the tensioning assembly to grip a portion of the main pole, such that two upper surfaces of the second tension clamp opens or closes in response to a rotation of the second small gear, such that the large gear is rotatably connected to the first small gear and the second small gear to control the rotation of the first small gear and the second small gear.

The exercise stick may further include a handle assembly attached to the tensioning assembly to allow a user to move the tensioning assembly in the first direction and the second direction.

The handle assembly may include a handle foot to attach to the tensioning assembly.

The tensioning assembly may further include a handle lock disposed within a central portion of a rear surface to receive the handle foot.

The handle lock may include a handle lock lever disposed within a top portion of the tensioning assembly to lock or unlock the handle foot within the handle lock, and a rotatable locking member disposed within a central portion of the handle lock to rotate in response to a manipulation of the handle lock lever, such that the handle foot is removable in the unlocked position and not removable in the locked position.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Figure 1A:
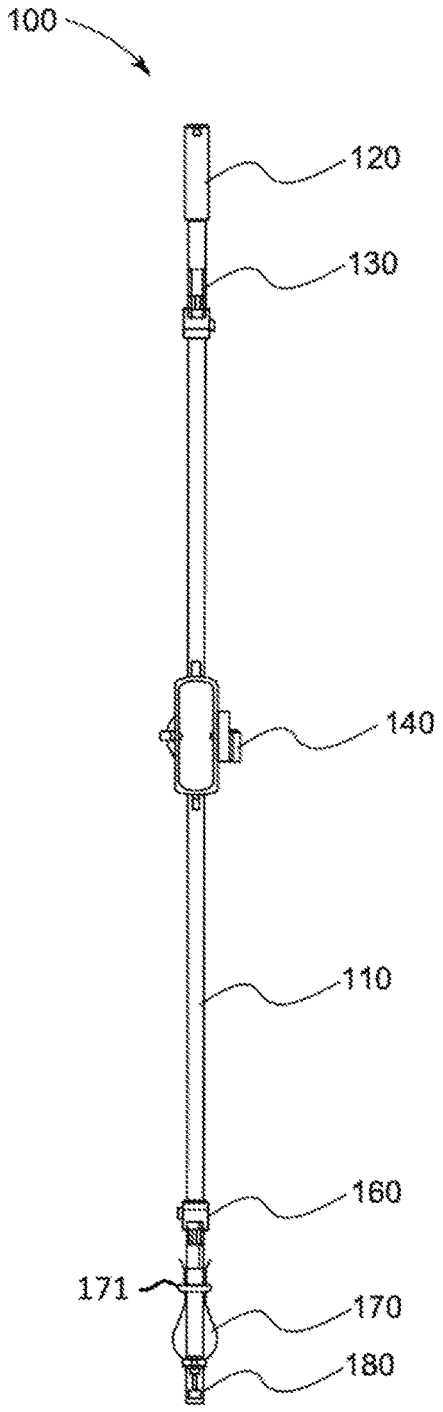
FIG. 1A illustrates a front perspective view of an exercise stick, according to an exemplary embodiment of the present general inventive concept.

FIG. 1A illustrates a front perspective view of an exercise stick 100, according to an exemplary embodiment of the present general inventive concept.

Figure 1B:
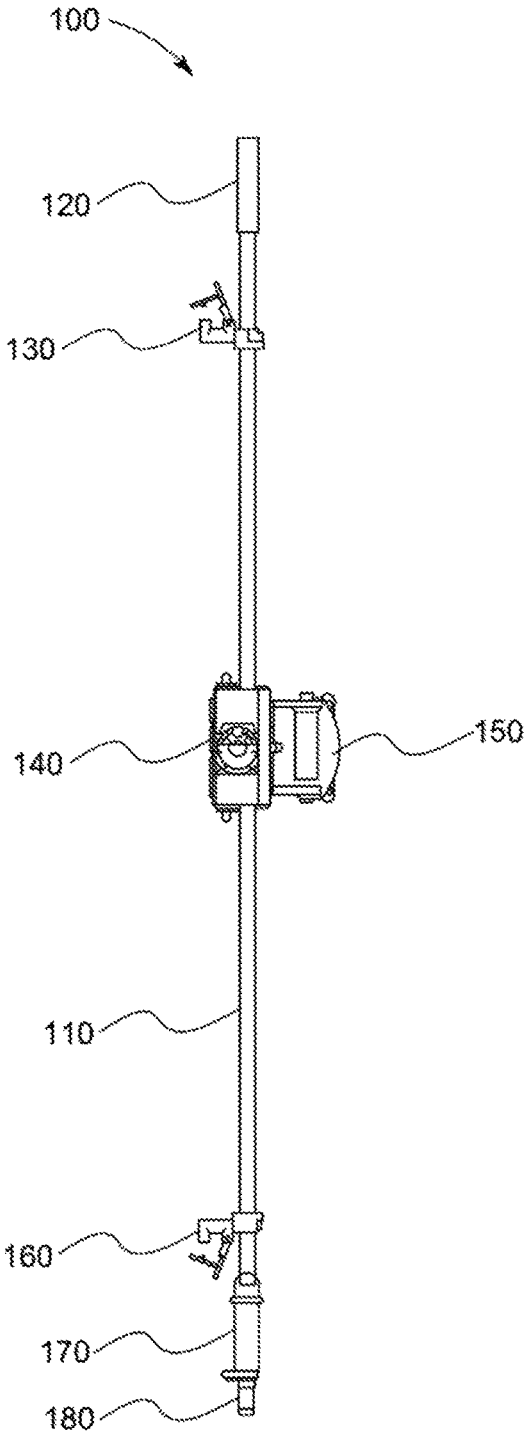
FIG. 1B illustrates a side perspective view of the exercise stick, according to an exemplary embodiment of the present general inventive concept.

FIG. 1B illustrates a side perspective view of the exercise stick 100, according to an exemplary embodiment of the present general inventive concept.

Referring to FIGS. 1A and 1B, the exercise stick 100 may include a main pole 110, an end cap 120, an upper resistance band clamp 130, a tensioning assembly 140, a handle assembly 150, a lower resistance band clamp 160, a plurality of foot straps 170, and a base portion 180, but is not limited thereto.

The main pole 110 may be unscrewed at one, two, or more points, in order to detach the main pole 110 into multiple portions to allow for easy storage of the main pole 110. In other words, the main pole 110 may be sectional in at least two separate pieces, and may be sectional in more pieces, such as three, four, five, six, etc., or alternatively, the main pole 110 may be a single pole piece.

The main pole 110 may be constructed from metal, plastic, glass, fiberglass, wood, rubber, or any other durable material known to one of ordinary skill in the art, and may have any size (when fully assembled), ranging from one foot to ten feet in length, but is not limited thereto.

The end cap 120 may be disposed at a top end of the main pole 110, and may be included to prevent components installed on the main pole 110 from sliding off the top end of the main pole 110. Also, the end cap 120 may be designed to be slightly smaller than a diameter of the main pole 110 (but is not limited thereto), in order to enable a user to easily install or remove the upper resistance band clamp 130, the tensioning assembly 140, the handle assembly 150, and/or the lower resistance band claim 160.

The upper resistance band clamp 130 may be disposed below the end cap 120 to be movable (i.e., slidable) along the main pole 110.

The tensioning assembly 140 may be disposed on the main pole 110 to be slidable along the main pole 110, such that the tensioning assembly 140 may be easy or difficult to slide along the main pole 110, based on a preference of a user.

The handle assembly 150 may be disposed on the tensioning assembly 140 to allow the user to move (i.e., slide) the tensioning assembly along the main pole 110.

As such, a combination of the tensioning assembly 140 and the handle assembly 150 may allow the user to exert energy when attempting to slide the tensioning assembly 140 along the main pole 110 in various different directions, thereby allowing the user to exercise using the exercise stick 100.

Also, the handle assembly 150 may be adjustable in any direction.

The lower resistance band clamp 160 may be disposed on the main pole 110 below the tensioning assembly 140, and may be slidable along the main pole 110.

The plurality of foot straps 170 may be disposed at a bottom portion of the main pole 110, and may be stored within foot strap holders 171 when the plurality of foot straps 170 are not in use.

The base portion 180 may be disposed at a bottom tip of the main pole 110, and may include a ball tip 181 that may be used to slide into another device, as preferred by the user. The ball tip 181 may be designed to protect a floor from scuff marks or scratches.

Figure 2A:
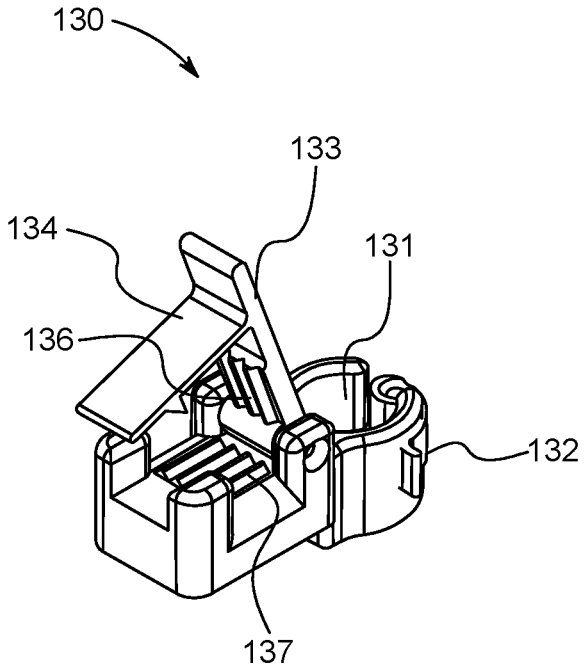
FIG. 2A illustrates a top front angled perspective view of an upper resistance band clamp, according to an exemplary embodiment of the present general inventive concept.

FIG. 2A illustrates a top front angled perspective view of the upper resistance band clamp 130, according to an exemplary embodiment of the present general inventive concept.

Figure 2B:
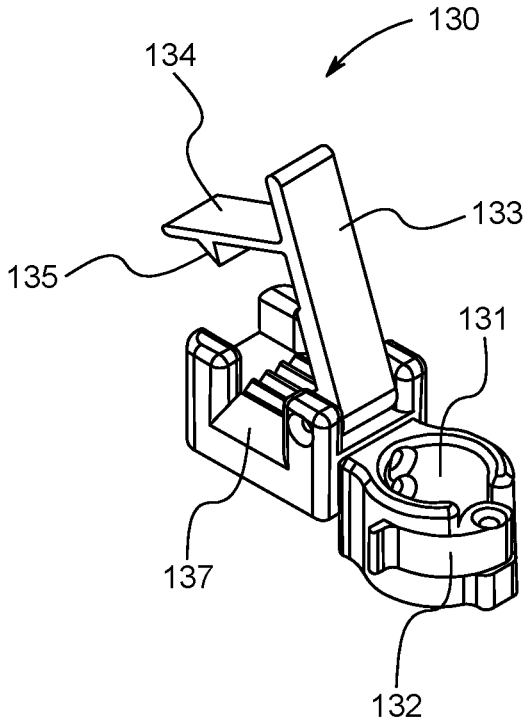
FIG. 2B illustrates a top rear angled perspective view of the upper resistance band clamp, according to an exemplary embodiment of the present general inventive concept.

FIG. 2B illustrates a top rear angled perspective view of the upper resistance band clamp 130, according to an exemplary embodiment of the present general inventive concept.

Figure 2C:
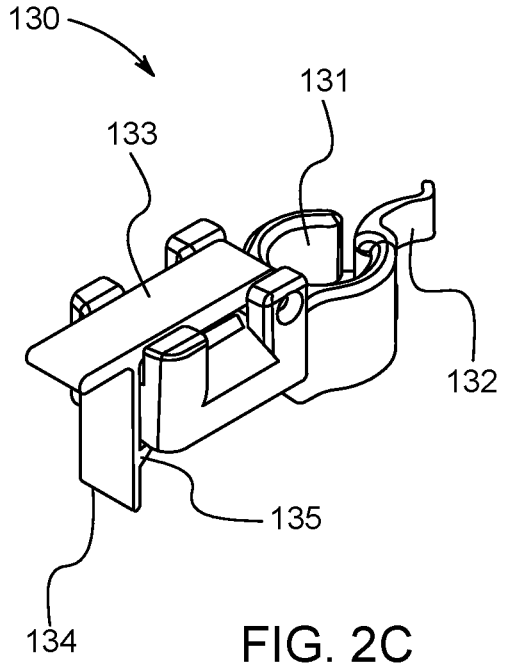
FIG. 2C illustrates another top front angled perspective view of the upper resistance band clamp, according to an exemplary embodiment of the present general inventive concept.

FIG. 2C illustrates another top front angled perspective view of the upper resistance band clamp 130, according to an exemplary embodiment of the present general inventive concept.

Figure 2D:
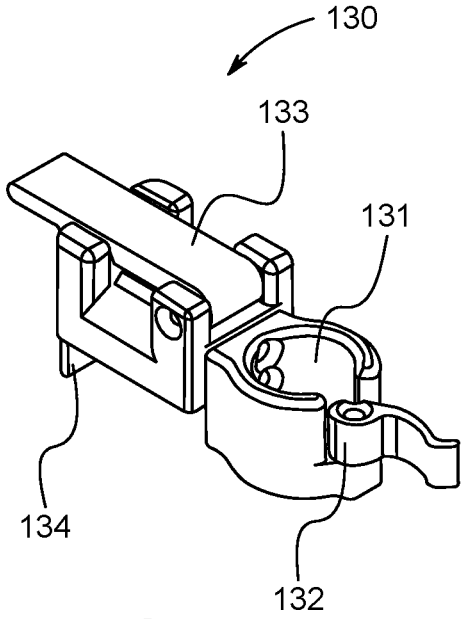
FIG. 2D illustrates another top rear angled perspective view of the upper resistance band clamp, according to an exemplary embodiment of the present general inventive concept.

FIG. 2D illustrates another top rear angled perspective view of the upper resistance band clamp 130, according to an exemplary embodiment of the present general inventive concept.

Referring to FIGS. 2A through 2D, the upper resistance band clamp 130 may include a pole receiving aperture 131, a pole locking clamp 132, a locking lever pivoting bar 133, a locking lever extension 134, a locking lever wedge 135, a plurality of upper ridges 136, and a plurality of lower ridges 137, but is not limited thereto.

The pole receiving aperture 131 may be designed to receive the main pole 110 therein, and may slide up and down the main pole 110.

The pole locking clamp 132 may lock the upper resistance band clamp 130 in place when the pole locking clamp 132 is rotated in a first direction, such that the pole locking clamp 132 remains stationary on the main pole 110. When the pole locking clamp 132 is rotated in a second direction, the pole locking clamp 132 may slide up and down the main pole 110.

The locking lever pivoting bar 133 may include the plurality of upper ridges 136 disposed on a lower surface thereof, and may pivot in a first direction to cause the locking lever extension 134, which is perpendicularly connected to the locking lever pivoting bar 133, to move downward until the plurality of upper ridges 136 contacts the plurality of lower ridges 137. Also, the locking lever wedge 135 may catch on a bottom surface of the upper resistance band clamp 130.

Figure 11A:
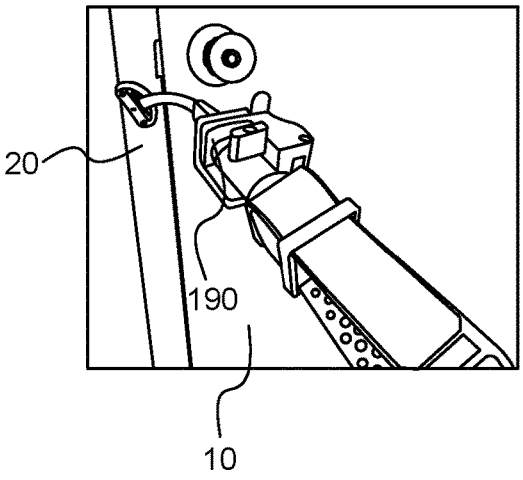
FIG. 11A illustrates a view of the door mount assembly attached between a door and a door jamb, according to an exemplary embodiment of the present general inventive concept.
Figure 11B:
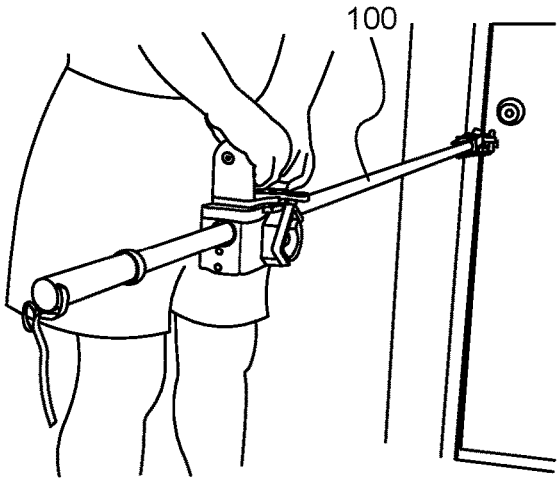
FIG. 11B illustrates another view of the door mount assembly attached between a door and a door jamb, according to an exemplary embodiment of the present general inventive concept.
Figure 11C:
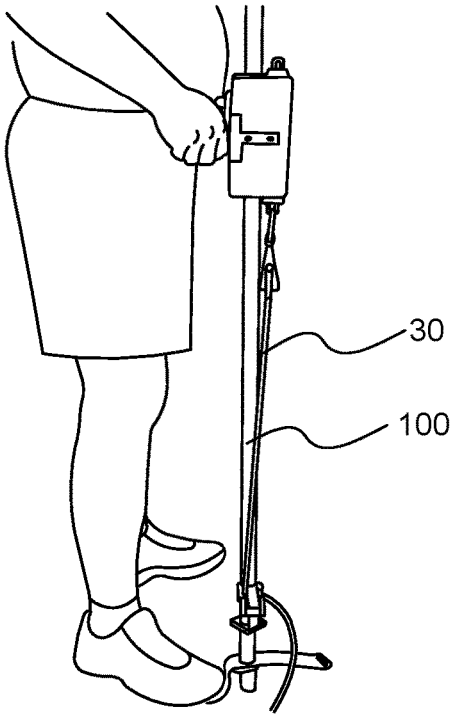
FIG. 11C illustrates a view of the exercise stick being used by a user while standing, according to an exemplary embodiment of the present general inventive concept.

A resistance band 30, as illustrated in FIG. 11C, may be placed between the plurality of upper ridges 136 and the plurality of lower ridges 137, such that the resistance band 30 is pinched (i.e., locked in place) therebetween.

The upper resistance band clamp 130 may have the same components as the lower resistance band clamp 160, and therefore, descriptions of the components of the lower resistance band clamp 160 will be omitted for the sake of brevity.

Figure 3A:
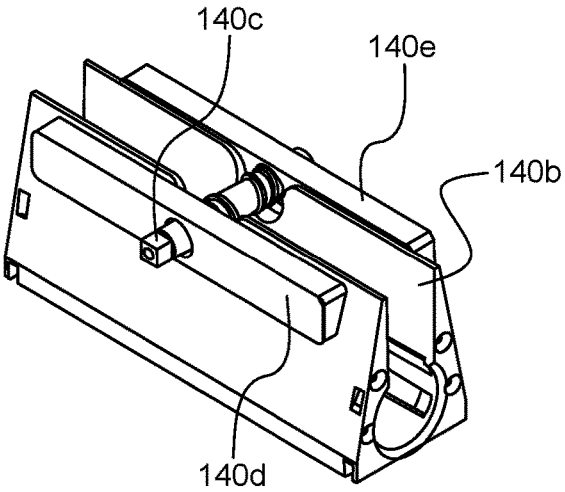
FIG. 3A illustrates a top front angled perspective view of a tension clamp, according to an exemplary embodiment of the present general inventive concept.

FIG. 3A illustrates a top front angled perspective view of a tension clamp 140*b*, according to an exemplary embodiment of the present general inventive concept.

Figure 3B:
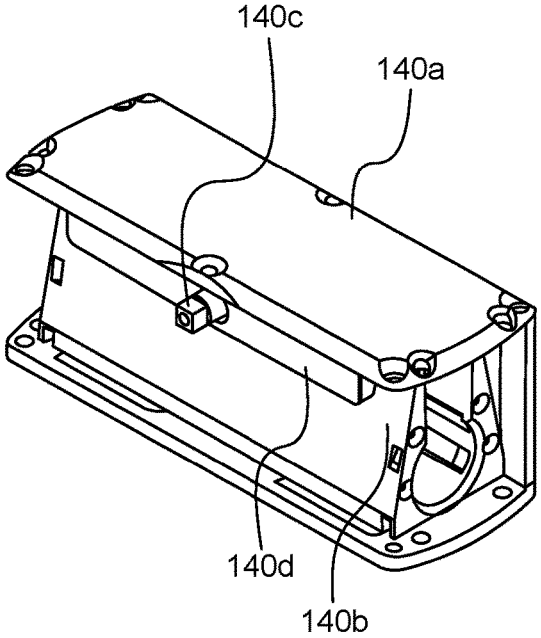
FIG. 3B illustrates a top front angled cross-sectional perspective view of the tension clamp disposed within a tensioning assembly housing, according to an exemplary embodiment of the present general inventive concept.

FIG. 3B illustrates a top front angled cross-sectional perspective view of the tension clamp 140*b* disposed within the tensioning assembly housing 140*a*, according to an exemplary embodiment of the present general inventive concept.

Figure 3C:
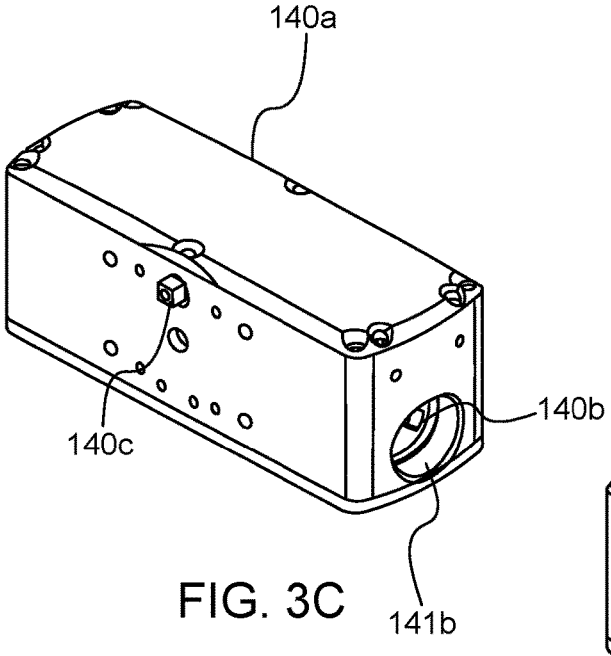
FIG. 3C illustrates a top front angled closed perspective view of the tension clamp disposed within the tensioning assembly housing, according to an exemplary embodiment of the present general inventive concept.

FIG. 3C illustrates a top front angled closed perspective view of the tension clamp 140*b* disposed within the tensioning assembly housing 140*a*, according to an exemplary embodiment of the present general inventive concept.

Figure 3D:
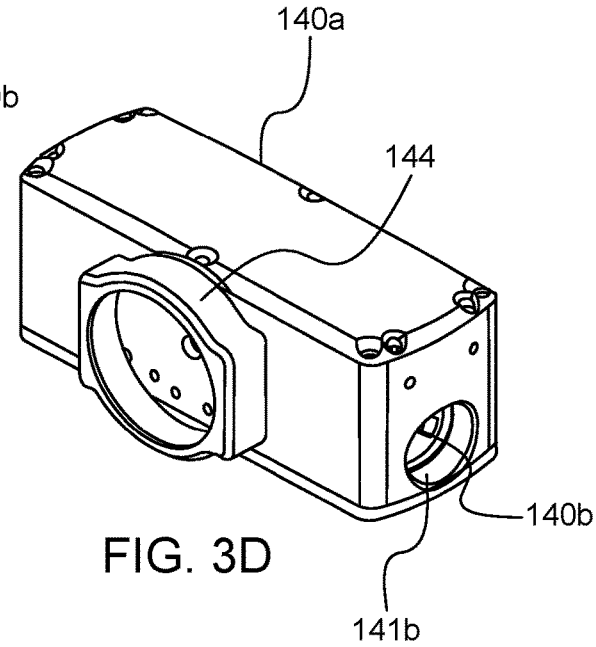
FIG. 3D illustrates a top front angled closed perspective view of the tension clamp disposed within the tensioning assembly housing having a dial assembly disposed thereupon, according to an exemplary embodiment of the present general inventive concept.

FIG. 3D illustrates a top front angled closed perspective view of the tension clamp 140*b* disposed within the tensioning assembly housing 140*a* having the dial assembly 144 disposed thereupon, according to an exemplary embodiment of the present general inventive concept.

Referring to FIGS. 3A through 3D, the tension clamp 140*b* may be formed to have a worm screw 140*c* disposed between two upper surfaces thereof, and held down by a first clamp shoe 140*d* and a second clamp shoe 140*e*. As such, when the worm screw 140*c* is twisted in a first direction, the two upper surfaces of the tension clamp 140*b* may be squeezed together. Therefore, if the tension clamp 140*b* is disposed on the main pole 110, a movement of the tension clamp 140*b* along the main pole 110 becomes more difficult as the worm screw 140*c* continues to be turned such that the two upper surfaces of the tension clamp 140*b* come closer together.

The tensioning assembly housing 140*a* may be disposed around the tension clamp 140*b*, and may include the dial assembly 144 disposed on a front surface thereof, such that the dial assembly 144 covers an end of the worm screw 140*c*.

The upper resistance band clamp 130 and the lower resistance band clamp 160 may allow a user (or a therapist) to vary positions and to achieve desired length of a band 30, as well as spacing of one end of the band 30 and the tension clamp 140*b*. The upper resistance band clamp 130 and the lower resistance band clamp 160 may each include a locking lever so they may be unlocked and moved/relocated to different levels on the main pole 110, locking them with a band of selected resistance.

Figure 4A:
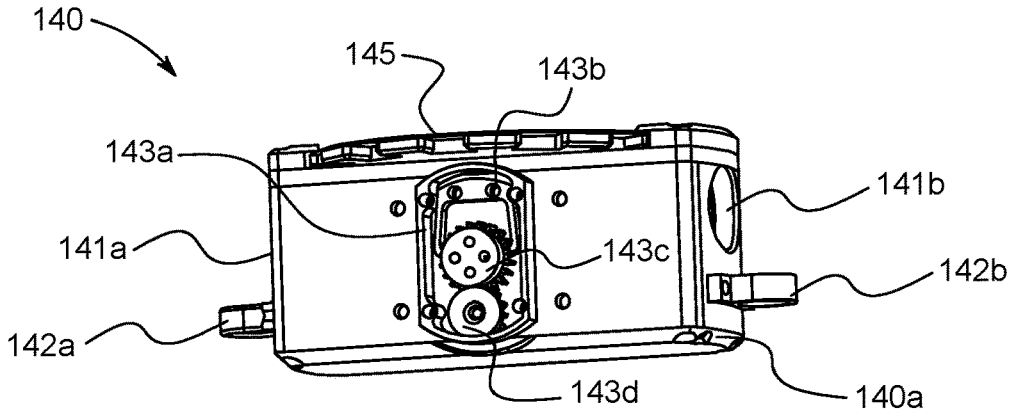
FIG. 4A illustrates a front perspective view of the tensioning assembly, according to an exemplary embodiment of the present general inventive concept.

FIG. 4A illustrates a front perspective view of the tensioning assembly 140, according to an exemplary embodiment of the present general inventive concept.

Figure 4B:
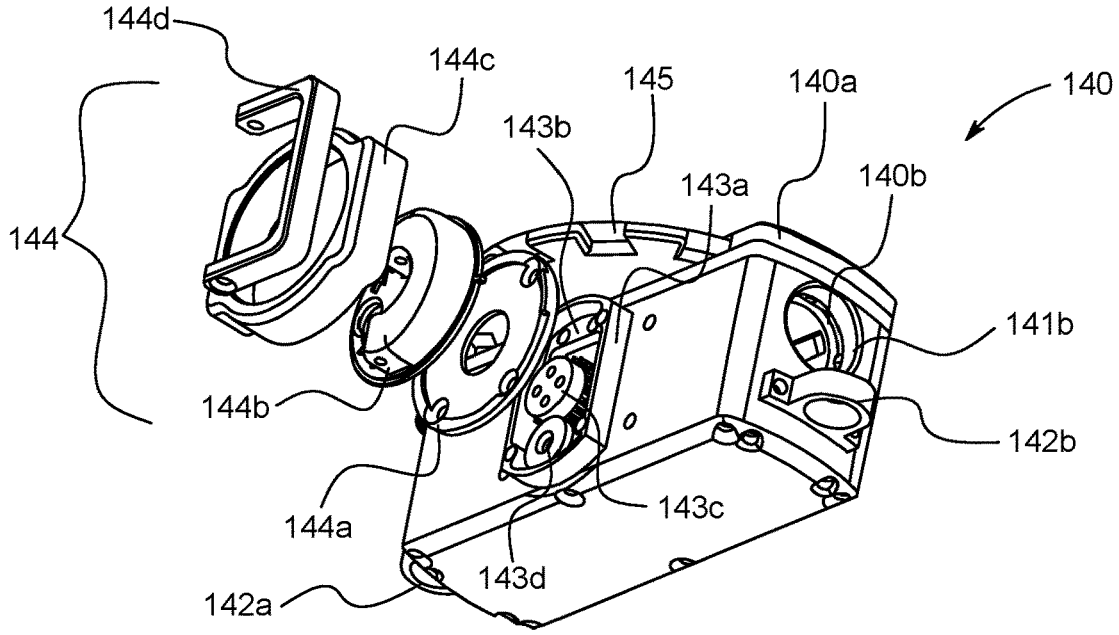
FIG. 4B illustrates a bottom front angled perspective view of the tensioning assembly including an exploded view of the dial assembly, according to an exemplary embodiment of the present general inventive concept.

FIG. 4B illustrates a bottom front angled perspective view of the tensioning assembly 140 including an exploded view of the dial assembly 144, according to an exemplary embodiment of the present general inventive concept.

Figure 4C:
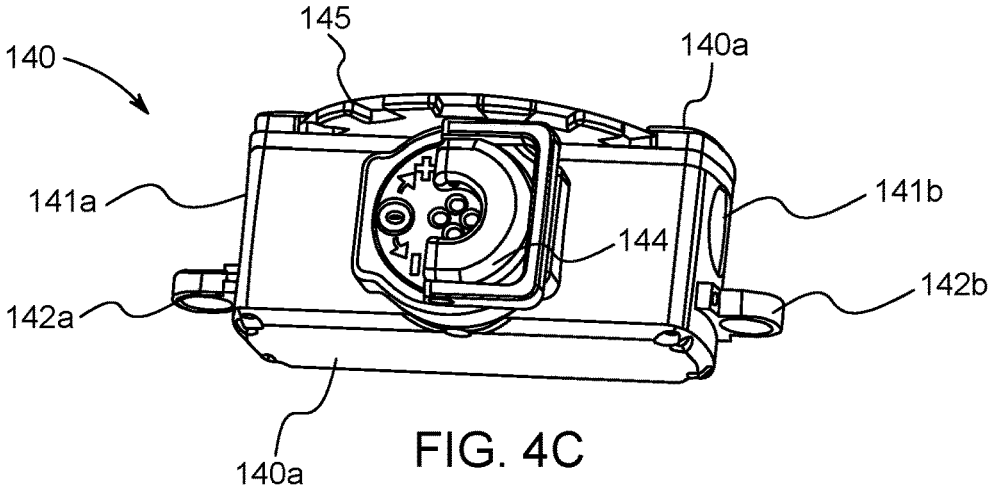
FIG. 4C illustrates a front perspective view of the tensioning assembly including the dial assembly disposed on a tensioning assembly housing, according to an exemplary embodiment of the present general inventive concept.

FIG. 4C illustrates a front perspective view of the tensioning assembly 140 including the dial assembly 144 disposed on the tensioning assembly housing 140*a*, according to an exemplary embodiment of the present general inventive concept.

Referring to FIGS. 4A through 4C, the tensioning assembly 140 may include a housing 140*a*, which includes a first pole aperture 141*a* at a first end of the housing 140*a*, and a second pole aperture 141*b* at a second end of the housing 140*a*, but is not limited thereto.

The tensioning assembly 140 may also include a first resistance band anchor loop 142*a* disposed at the first end of the housing 140*a*, and a second resistance band anchor loop 142*b* disposed at the second end of the housing 140*a*. The first resistance band anchor loop 142*a* may receive a first end of a resistance band 30, such that a second end of the resistance band 30 may be attached to the upper resistance band clamp 130. The second resistance band anchor loop 142*b* may receive a first end of another resistance band 30, such that a second end of the another resistance band 30 may be attached to the lower resistance band clamp 160.

The tensioning assembly 140 may also include, disposed on a front surface thereof, a dial support 143*a*, an indexing clamp 143*b*, a dial cover gear 143*c*, and a worm gear 143*d*, but is not limited thereto.

The dial support 143*a* may receive thereon the dial assembly 144, specifically, first a number dial 144*a*, then a dial cover 144*b*, then a dial cap 144*c*, and a dial handle 144*d*. The number dial 144*a* may be attached to the dial cover gear 143*c*, which is connected to the worm gear 143*d*, such that turning the number dial 144*a* in a first direction or a second direction causes the dial cover gear 143*c* to turn in a first direction or a second direction, thereby causing the worm gear 143*d* to turn in a first direction or a second direction, which causes the worm screw 140*c* to turn and either tighten or loosen the two upper surfaces of the tension clamp 140*b* around the main pole 110. When the dial cover gear 143*c* turns in a first direction, the worm gear 143*d* turns in a direction opposite from the first direction of the turning dial cover gear 143*c*.

Figure 5A:
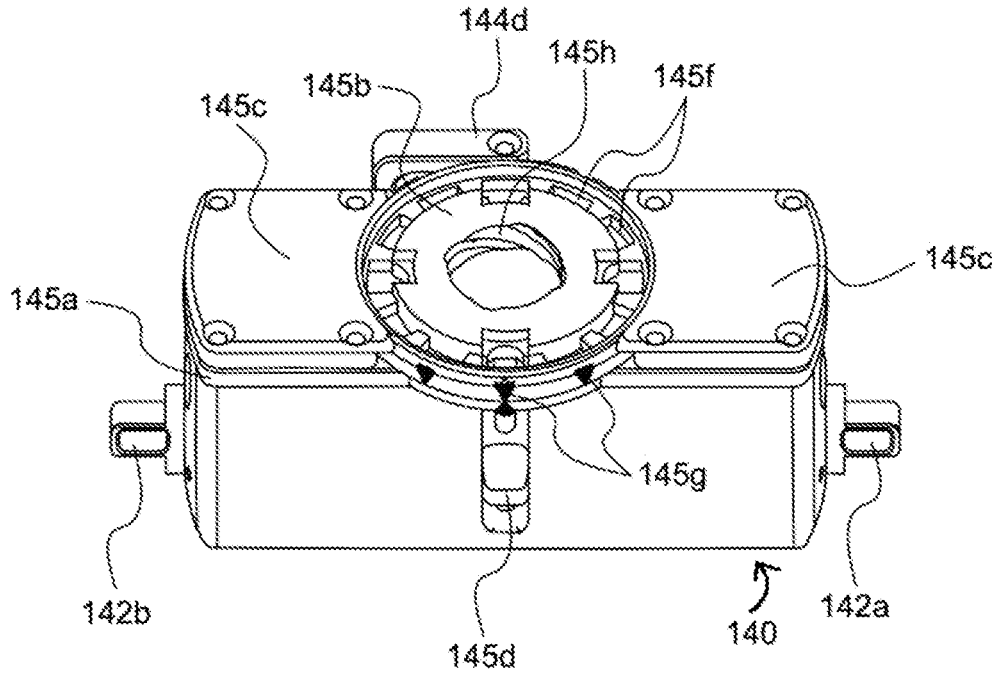
FIG. 5A illustrates a front angled perspective view of a wheel sub assembly, according to an exemplary embodiment of the present general inventive concept.

FIG. 5A illustrates a front angled perspective view of the wheel sub assembly 145, according to an exemplary embodiment of the present general inventive concept.

Figure 5B:
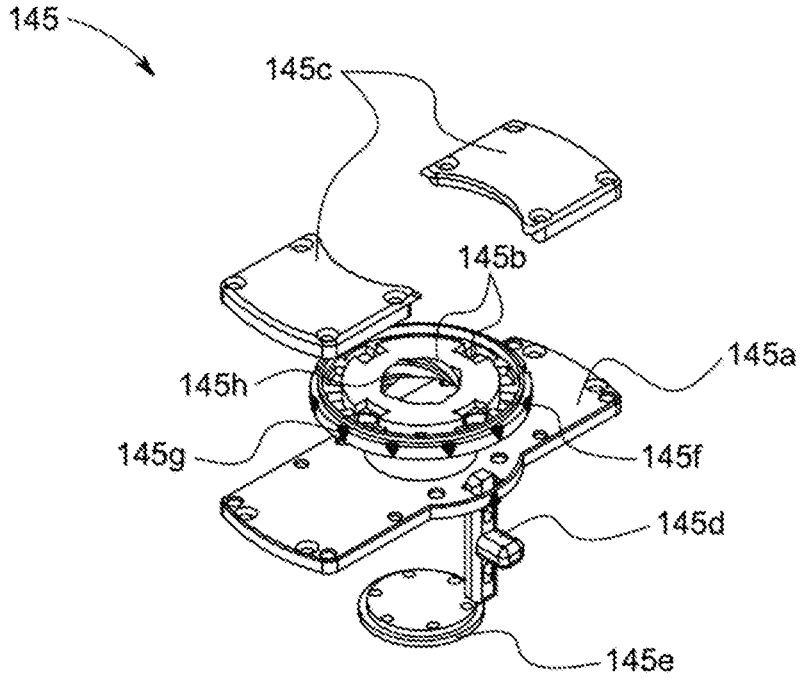
FIG. 5B illustrates a top angled exploded perspective view of the wheel sub assembly, according to an exemplary embodiment of the present general inventive concept.

FIG. 5B illustrates a top angled exploded perspective view of the wheel sub assembly 145, according to an exemplary embodiment of the present general inventive concept.

Figure 6:
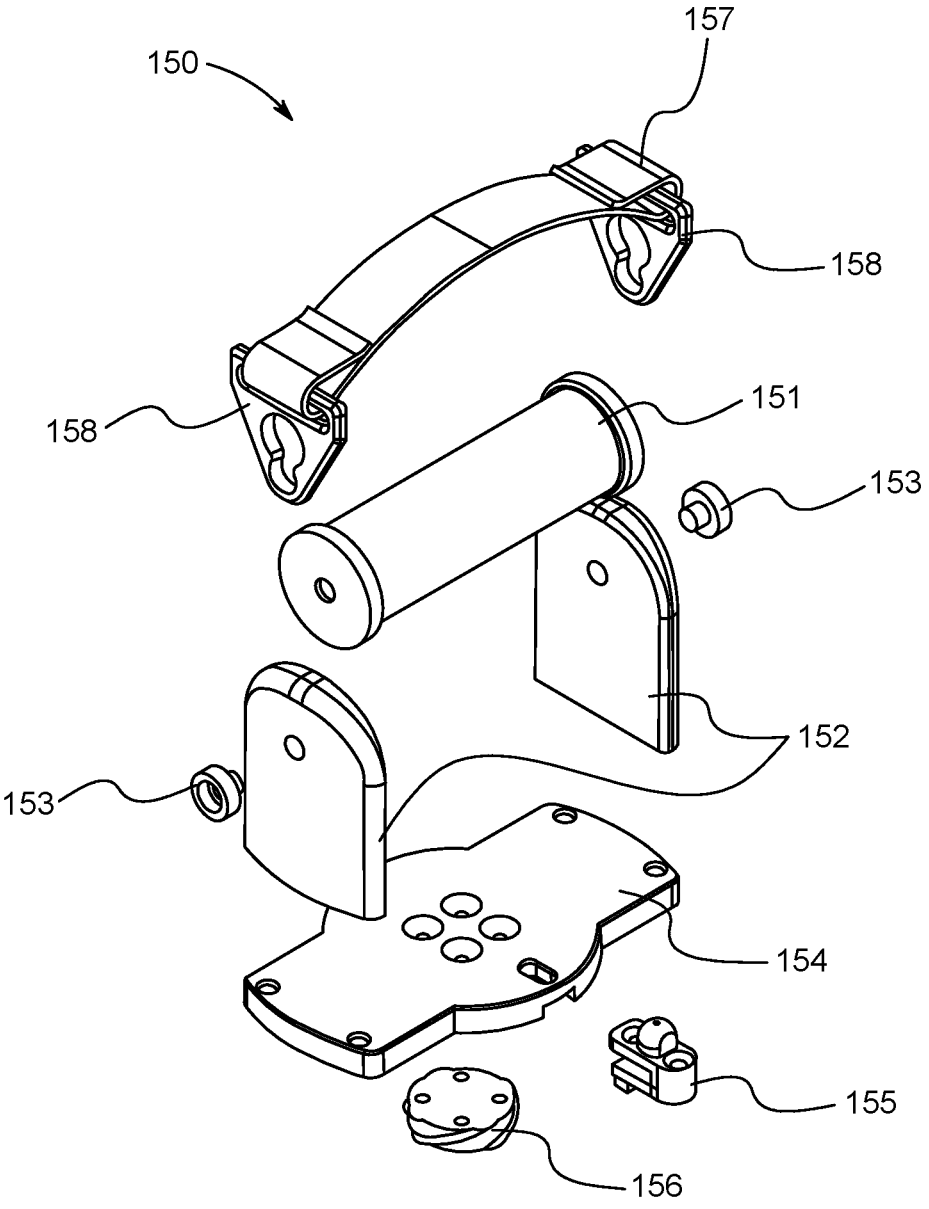
FIG. 6 illustrates a top angled exploded perspective view of a handle assembly, according to an exemplary embodiment of the present general inventive concept.

Referring to FIGS. 5A and 5B, the wheel sub assembly 145 may include a housing top 145*a* disposed on the housing 140*a* of the tensioning assembly 140, a wheel 145*b* disposed on the housing top 145*a*, a plurality of housing caps 145*c* to prevent the wheel 145*b* from being removed from the housing top 145*a*, a wheel lock lever 145*d* extending downward from the housing top and connected to the housing 140*a* to prevent the wheel 145*b* from moving by sliding upwards into one of a plurality of wheel slots 145*f*, a wheel plug 145*e* to connect to the wheel 145*b* from underneath the housing top 145*a*, a plurality of locating marks 145*g* disposed around a circumference of the wheel 145*b* to annotate where the wheel slots 145*f* are located, and a threaded aperture 145*h* disposed at a center portion of the wheel 145*b* to accept a threaded base 156 of the handle assembly 150, as illustrated in FIG. 6.

FIG. 6 illustrates a top angled exploded perspective view of the handle assembly 150, according to an exemplary embodiment of the present general inventive concept.

Referring to FIG. 6, the handle assembly 150 may include a handle tubing 151 (preferably at least partially constructed from non-slip material) that is attached at two ends thereof to two handle arms 152 by two caps 153. The two handle arms 152 may each be attached at base portions thereof to a handle base 154, which may be attached to the threaded aperture 145*h* of the wheel 145*b* via the threaded base 156, which may be locked to the wheel 145*b* using a sliding handle lock 155.

An adjustable strap 157 may be attached at side portions thereof, the side portions that each contain a removable strap holder 158, to the two caps 153.

As such, the handle assembly 150 may be attached to the wheel sub assembly 145 of the tensioning assembly 140.

Figure 7:
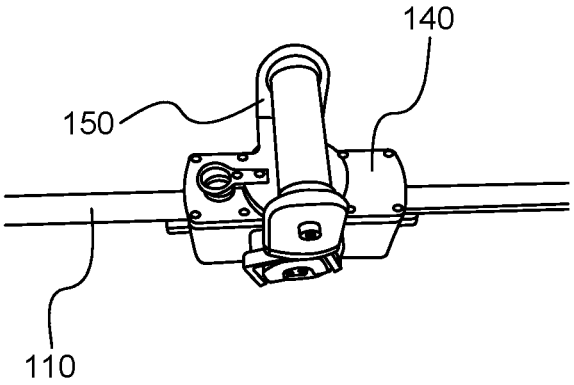
FIG. 7 illustrates a rear angled perspective view of the handle assembly disposed on the tensioning assembly as disposed on the main pole, according to an exemplary embodiment of the present general inventive concept.

FIG. 7 illustrates a rear angled perspective view of the handle assembly 150 disposed on the tensioning assembly 140 as disposed on the main pole 110, according to an exemplary embodiment of the present general inventive concept.

Referring to FIG. 7, it is clear that the tensioning assembly 140 may slide along the main pole 110 when a user grabs and pulls on the handle assembly 150.

Figure 8A:
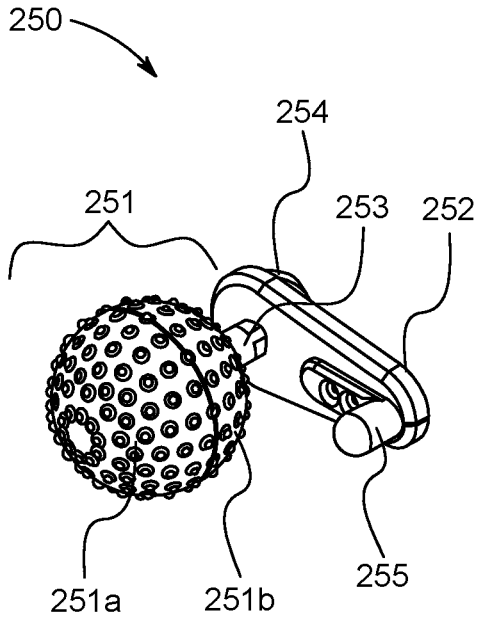
FIG. 8A illustrates a front angled perspective view of a handle assembly, according to another exemplary embodiment of the present general inventive concept.

FIG. 8A illustrates a front angled perspective view of a handle assembly 250, according to another exemplary embodiment of the present general inventive concept.

Figure 8B:
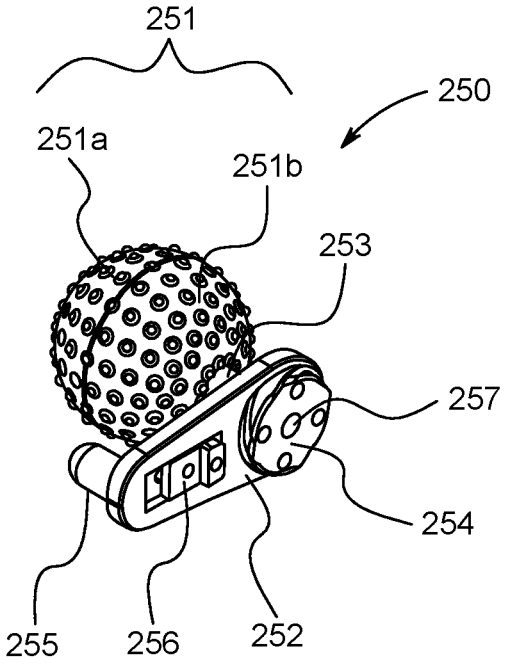
FIG. 8B illustrates a rear angled perspective view of the handle assembly, according to another exemplary embodiment of the present general inventive concept.

FIG. 8B illustrates a rear angled perspective view of the handle assembly 250, according to another exemplary embodiment of the present general inventive concept.

Figure 8C:
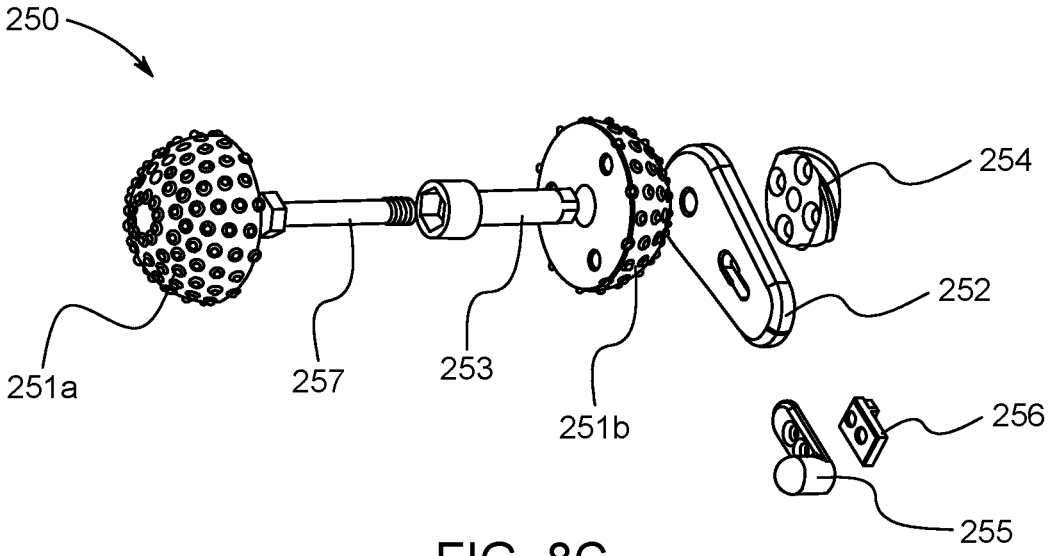
FIG. 8C illustrates a side exploded perspective view of the handle assembly, according to another exemplary embodiment of the present general inventive concept.

FIG. 8C illustrates a side exploded perspective view of the handle assembly 250, according to another exemplary embodiment of the present general inventive concept.

Referring to FIGS. 8A through 8C, the handle assembly 250 may include a ball 251, which includes a first half ball 251*a* and a second half ball 251*b*, which may have a plurality of rained bumps on surfaces thereof to promote gripping of the ball 251. The first half ball 251*a* may have a bolt 257 attached to an inner portion thereof to connect to an attachment member 253 disposed on an inner portion of the second half ball 251*b*, which may connect the ball 251 to a ball handle 252.

A peg 255 may be attached to an end of the ball handle 252 opposite from an end at which the ball 251 is attached, in order to connect the handle assembly 250 to the wheel 145*b* via a threaded base 254. A sliding lever lock 256 may lock the threaded base 254 to the wheel 145*b*, and may be locked and/or unlocked for each of use.

Figure 9:
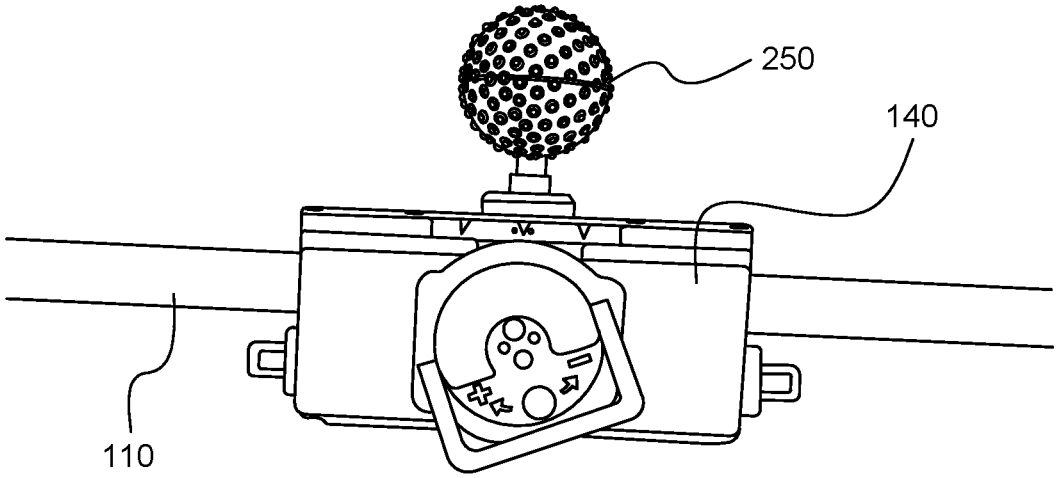
FIG. 9 illustrates a front perspective view of the handle assembly disposed on the tensioning assembly as disposed on the main pole, according to another exemplary embodiment of the present general inventive concept.

FIG. 9 illustrates a front perspective view of the handle assembly 250 disposed on the tensioning assembly 140 as disposed on the main pole 110, according to another exemplary embodiment of the present general inventive concept.

Referring to FIG. 9, it is clear that the tensioning assembly 140 may slide along the main pole 110 when a user grabs and pulls and/or pushes on the handle assembly 250.

Figure 10:
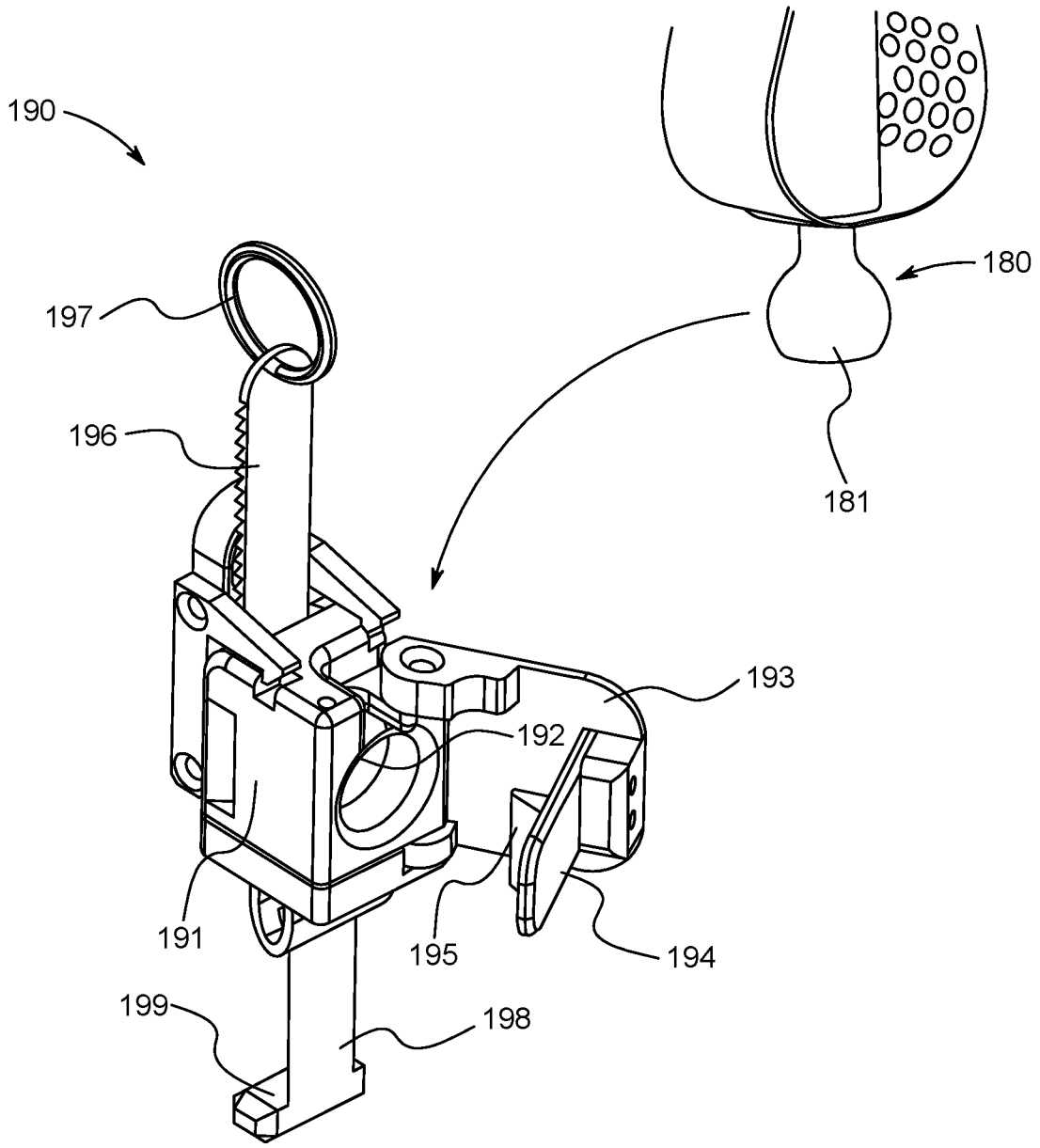
FIG. 10 illustrates a top angled perspective view of a door mount assembly, according to an exemplary embodiment of the present general inventive concept.

FIG. 10 illustrates a top angled perspective view of a door mount assembly 190, according to an exemplary embodiment of the present general inventive concept.

The door mount assembly 190 may be included in order to position the exercise stick 100 in various horizontal and/or angular positions with respect to the user and/or the floor.

Referring to FIG. 10, the door mount assembly 190 may include a main body 191, a ball receiving aperture 192, a clamp door 193, a clamp foot 194, a clamp wedge 195, a notched ribbon 196, a pull ring 197, a mounting ribbon 198, and a butt end 199, but is not limited thereto.

The ball tip 181 of the base portion 180 of the exercise stick 100 may be placed into the ball receiving aperture 192, and then the clamp door may pivotably close the ball tip 181 within the ball receiving aperture 192 such that the clamp wedge 195 disposed at a tip of the clamp foot 194 may catch onto a portion of the main body 191 to maintain the ball tip 181 within the ball receiving aperture 192.

The mounting ribbon 198 may be attached to the notched ribbon 196, such that pulling the pull ring 197 may cause both the notched ribbon 196 and the mounting ribbon 198 to move within the main body 191.

The mounting ribbon 198 may be placed between a door and a door jamb, such that the butt end 199 remains on a side of the door opposite of where the user is standing, such that pulling on the exercise stick 100 does not cause the exercise stick to move away from the area between the door and the door jamb.

FIG. 11A illustrates a view of the door mount assembly 190 attached between a door 10 and a door jamb 20, according to an exemplary embodiment of the present general inventive concept.

FIG. 11B illustrates another view of the door mount assembly 190 attached between a door 10 and a door jamb 20, according to an exemplary embodiment of the present general inventive concept.

FIG. 11C illustrates a view of the exercise stick 100 being used by a user while standing, according to an exemplary embodiment of the present general inventive concept.

Figure 11D:
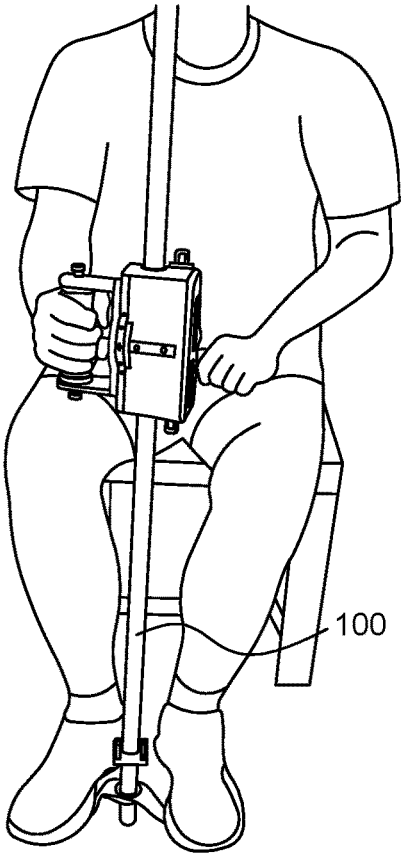
FIG. 11D illustrates a view of the exercise stick being used by a user while seated, according to an exemplary embodiment of the present general inventive concept.

FIG. 11D illustrates a view of the exercise stick 100 being used by a user while seated, according to an exemplary embodiment of the present general inventive concept.

As illustrated in FIGS. 11A through 11D, the exercise stick 100 may be used by the user when the user steps on the plurality of foot straps, or alternatively, places the mounting ribbon 198 between the door 10 and the door jamb 20, and then pulls on and/or pushes the handle assembly 150 such that the tensioning assembly 140 may slide along the main pole 110. As stated above, the resistance band(s) 30 may be added between the tensioning assembly 140 and the upper resistance band clamp 130 and/or the lower resistance band clamp 160, in order to provide the user with alternative, additional, and/or optional resistance when sliding the tensioning assembly 140 along the main pole 110. In other words, the upper resistance band clamp 130 and/or the lower resistance band clamp 160 may allow the user to feel alternating muscle groups activated as the user pushes and pulls on the handle assembly 150.

The main purpose of the exercise stick 100 is to provide individuals exercise equipment/a device that requires no weights, bands or springs. The exercise stick 100 provides adjustable resistive force to challenge and strengthen muscles, similar to strengthening encountered from lifting progressively heavier free-weights or by using weighted gym equipment, such as that found in health clubs. As stated above, there is a plethora of scientific studies available that describe physical, psychological, as well as immune-enhancing benefits of resistive exercise. The exercise stick 100 helps individuals partake in an exercise regimen to keep muscles, connective tissue, and bones strong, which are essential to good, long-term health. The exercise stick 100 offers individuals effective strength-training equipment that is light-weight, easy to use, and easy to transport. Furthermore, the exercise stick 100 can be used in the home or virtually anywhere desired, and requires no weights, springs or bands, but may include tension bands for extra resistance if desired. The exercise stick 100 can be used in vertical, horizontal or angular ways, and has a graded resistance available to customize resistive tension for each person and exercise. The exercise stick 100 could prove to be a vital exercise tool for those needing rehab equipment or those who simply want an effective low-cost alternative to gym equipment, club memberships, etc., that is easy to use and travels well.

Of further importance, is that the exercise stick 100 is naturally low-impact and very safe since it uses no heavy weights which have a number of inherent dangers, and requires no bands or springs which can cause injury when unexpectedly breaking or snapping back. Also, users of the exercise stick 100 can stop any movement abruptly with no danger, and they can regulate and select the exercise tension to their preference. They will not risk equipment malfunction or endanger themselves by selecting too high a resistance.

Weights and dumbbells provide long-term progressive resistance exercise, and one can merely select increasingly heavier weights over time to continue to challenge each muscle group. The exercise stick 100 introduces a resilient workout apparatus that individuals can use over many years to exercise, tone and strengthen virtually all arm, leg and core muscles in a progressive fashion similar to that when utilizing free-weights.

Individuals can shorten duration of workout sessions because the exercise stick 100 works the antagonist muscle immediately, in a fraction of a second, after the agonist is worked, with no equipment setup change needed, (for example the bicep is worked immediately following the triceps). This applies to all muscle groups and movements performed with exercise stick 100. Because of its adjustability, the exercise stick 100 can be employed throughout all stages of rehabilitation, and may also be used for long-term exercise and strength-training.

The exercise stick 100 is the only product of its kind to provide a versatile exercise device to assist users at any stage of life, to promote health and well-being. The exercise stick 100 is both a useful rehabilitation tool as well as well as general strengthening equipment. It is uniquely designed to be able to be split into multiple equal parts, offering convenience when transporting or storing. It may also include a padded carrying/storage case to allow for convenient storage and transport of the exercise stick 100, and the case may include separate compartments for storage of all of the components of the exercise stick 100.

The exercise stick 100 may be designed to allow various different muscle groups to be activated during use, based on a change of an angle of the handle assembly 150 with respect to the user. Also, adjustability of the tension of the exercise stick 100 may allow a therapist and a user to monitor and note clear definable strength changes over time and/or over the course of therapy intervention. Changing the tension grade by increasing or decreasing it enables therapists and users to limit, or intensify strengthening. Higher numbers on the dial 144*a* may indicate the patient is performing at a higher/stronger level (which may be important for documentation purposes of therapists so they may demonstrate a patient's/client's progress, to keep physicians informed or for verifying progress to insurers when submitting for reimbursement, and to justify for an attending physician or payer the appropriateness to continue or stop therapy). In some cases (depending on stage of healing) the physician may want the patient to not overstress a muscle or tendon that they have surgically altered or repaired (for example, tendons have less or greater tensile strength at different stages/times following surgery/repair).

Figure 12:
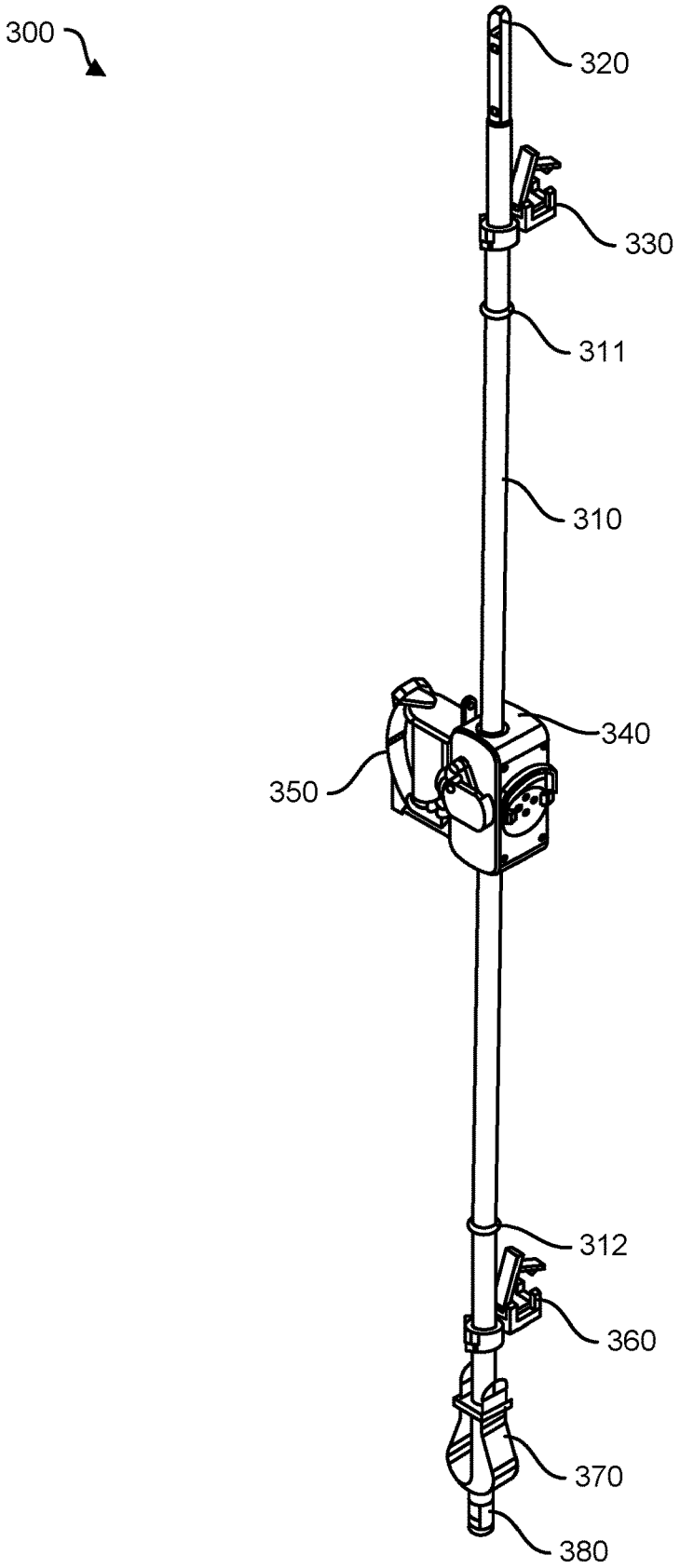
FIG. 12 illustrates a side perspective view of an exercise stick, according to another exemplary embodiment of the present general inventive concept.

FIG. 12 illustrates a side perspective view of an exercise stick 300, according to another exemplary embodiment of the present general inventive concept.

Figure 13B:
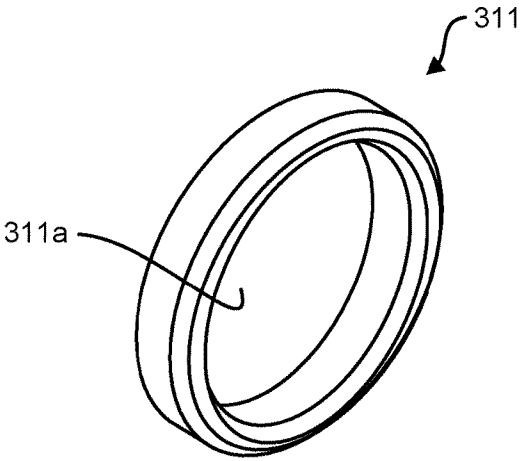
FIG. 13B illustrates a front perspective view of an upper target ring, according to another exemplary embodiment of the present general inventive concept.
Figure 13C:
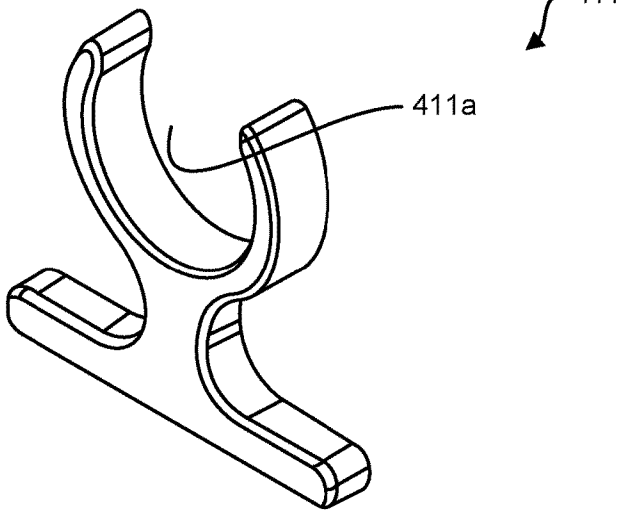
FIG. 13C illustrates a front perspective view of an upper target clip, according to another exemplary embodiment of the present general inventive concept.
Figure 13A:
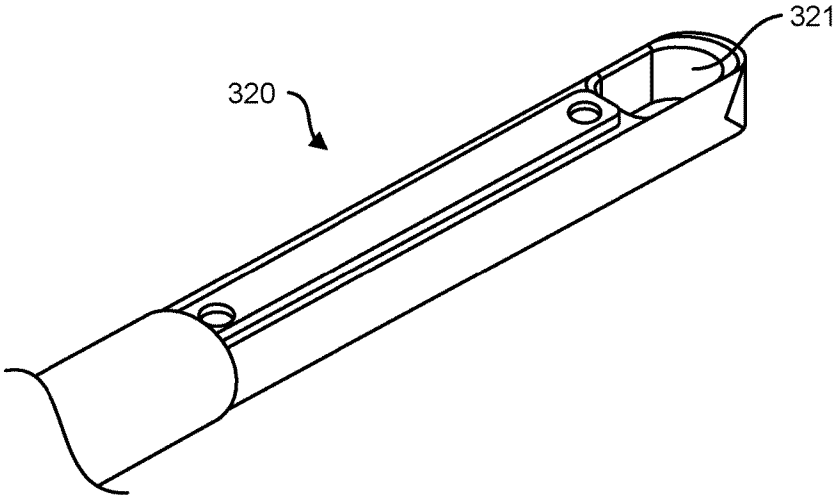
FIG. 13A illustrates a top isometric perspective view of an end cap, according to another exemplary embodiment of the present general inventive concept.

FIG. 13A illustrates a top isometric perspective view of the end cap 320, according to another exemplary embodiment of the present general inventive concept.

The exercise stick 300 may include a main pole 310, the upper target ring 311, a lower target ring 312, an end cap 320, an upper resistance band clamp 330, a tensioning assembly 340, a handle assembly 350, a lower resistance band clamp 360, a plurality of foot straps 370, and a base portion 380, but is not limited thereto.

The main pole 310 may be unscrewed at one, two, or more points, in order to detach the main pole 310 into multiple portions to allow for easy storage of the main pole 310. In other words, the main pole 310 may be sectional in at least two separate pieces, and may be sectional in more pieces, such as three, four, five, six, etc., or alternatively, the main pole 310 may be a single pole piece.

The main pole 310 may be constructed from metal, plastic, glass, fiberglass, wood, rubber, or any other durable material known to one of ordinary skill in the art, and may have any size (when fully assembled), ranging from one foot to ten feet in length, but is not limited thereto.

The end cap 320 may include a hook-receiving aperture 321, but is not limited thereto.

The end cap 320 may be disposed at a top end of the main pole 310, and may be included to prevent components installed on the main pole 310 from sliding off the top end of the main pole 310. Also, the end cap 320 may be designed to be slightly smaller than a diameter of the main pole 310 (but is not limited thereto), in order to enable a user to easily install or remove the upper resistance band clamp 330, the tensioning assembly 340, the handle assembly 350, and/or the lower resistance band claim 360. Furthermore, the hook-receiving aperture 321 may receive a hook (not illustrated), such that the exercise stick 300 is hanged for storage.

The upper resistance band clamp 330 may be disposed below the end cap 320 to be movable (i.e., slidable) along the main pole 310.

The upper target clip 311 may be disposed below the upper resistance band clamp 330 to be movable (i.e. slidable) along the main pole 310.

The tensioning assembly 340 may be disposed on the main pole 310 to be slidable along the main pole 310, such that the tensioning assembly 340 may be easy or difficult to slide along the main pole 310, based on a preference of the user.

The handle assembly 350 may be disposed on the tensioning assembly 340 to allow the user to move (i.e., slide) the tensioning assembly along the main pole 310.

As such, a combination of the tensioning assembly 340 and the handle assembly 350 may allow the user to exert energy when attempting to slide the tensioning assembly 340 along the main pole 310 in various different directions, thereby allowing the user to exercise using the exercise stick 300.

Also, the handle assembly 350 may be adjustable in any direction.

The lower target clip 312 may be disposed on the main pole 310 below the tensioning assembly 340, and may be slidable along the main pole 310.

The lower resistance band clamp 360 may be disposed on the main pole 110 below the lower target clip 312, and may be slidable along the main pole 310.

The plurality of foot straps 370 may be disposed at a bottom portion of the main pole 310.

The base portion 380 may be disposed at a bottom tip of the main pole 310.

FIG. 13B illustrates a front perspective view of an upper target ring 311, according to another exemplary embodiment of the present general inventive concept.

Referring to FIG. 13B, the upper target ring 311 may include a pole-receiving aperture 311*a*, but is not limited thereto.

The pole-receiving aperture 311*a* may be designed to receive the main pole 310 therein, such that the upper target ring 311 may slide up and down the main pole 310. The upper target ring 311 may be a target for the user to reach during exercise using the tensioning assembly 340.

The lower target ring 312 may be similar in function and scope with the only exception being its placement at a different location of the main pole 310.

FIG. 13C illustrates a front perspective view of an upper target clip 411, according to another exemplary embodiment of the present general inventive concept.

Referring to FIG. 13C, the upper target clip 411 may include a pole-receiving portion 411*a*, but is not limited thereto.

The pole-receiving portion 411*a* may be designed to receive the main pole 310 therein, such that the upper target clip 411 may slide up and down the main pole 310. The upper target clip 411 may be a target for the user to reach during exercise using the tensioning assembly 340.

The lower target ring 412 may be similar in function and scope with the only exception being its placement at a different location of the main pole 310.

Figure 14:
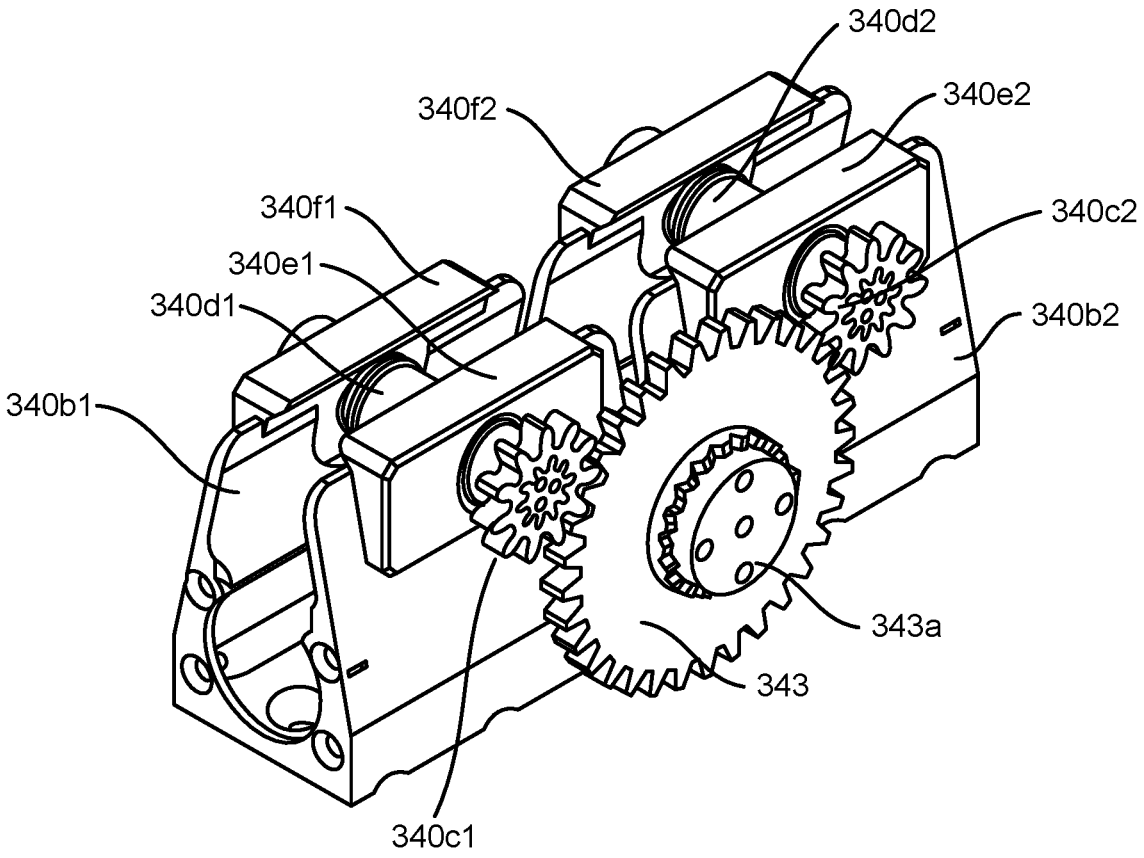
FIG. 14 illustrates a top isometric perspective view of a large gear disposed between a first tension clamp and a second tension clamp, according to another exemplary embodiment of the present general inventive concept.

FIG. 14 illustrates a top isometric perspective view of a large gear 343 disposed between a first tension clamp 340*b*1 and a second tension clamp 340*b*2 (collectively, a pair of tension clamps), according to another exemplary embodiment of the present general inventive concept.

Referring to FIG. 14, the first tension clamp 340*b*1 may be formed to have a first worm screw 340*d*1 disposed between two upper surfaces thereof, and held down by a first clamp shoe 340*e*1 and a second clamp shoe 340*f*1. Additionally, a first small gear 340*c*1 may be disposed on a first end of the first worm screw 340*d*1. Concordantly, the second tension clamp 340*b*2 may be formed to have a second worm screw 340*d*2 disposed between two upper surfaces thereof, and held down by a first clamp shoe 340*e*2 and a second clamp shoe 340*f*2. Additionally, a second small gear 340*c*2 may be disposed on a first end of the second worm screw 340*d*2. As such, the two upper surfaces of the first tension clamp 340*b*1 and the two upper surfaces of the second tension clamp 340*b*2 may be squeezed together (i.e. closes) in response to the first small gear 340*c*1 rotating the first worm screw 340*d*1 in a first direction or a second direction and the second small gear 340*c*2 rotating the second worm screw 340*d*2 in the first direction or the second direction. Therefore, if the pair of tension clamps are disposed on the main pole 310, a movement of the pair of tension clamps along the main pole 310 becomes more difficult as the first small gear 340*c*1 and the second small gear 340*c*2 continues to be turned, such that the two upper surfaces of the first tension clamp 340*b*1 and the two upper surfaces of the second tension clamp 340*b*2 come closer together.

Conversely, when the first small gear 340*c*1 and the second small gear 340*c*2 are rotated in the second direction or the first direction, the two upper surfaces of the first tension clamp 340*b*1 and the two upper surfaces of the second tension clamp 340*b*2 may spread apart (i.e. opens). Therefore, if the pair of tension clamps are disposed on the main pole 310, a movement of the pair of tension clamps along the main pole 310 becomes easier as the first small gear 340*c*1 and the second small gear 340*c*2 continues to be turned, such that the two upper surfaces of the first tension clamp 340*b*1 and the two upper surfaces of the second tension clamp 340*b*2 spread farther apart.

The small gear 340*c*1 and the small gear 340*c*2 may be substantially the same size and construction, such that they may have a predetermined amount of teeth (e.g., eleven teeth).

The large gear 343 may include an index spacer 343*a*, but is not limited thereto.

Moreover, the large gear 343 may be disposed between the pair of tension clamps. Specifically, a plurality of teeth of the large gear 343 may be interlocked with a plurality of teeth of the first small gear 340*c*1 and a plurality of teeth of the second small gear 340*c*2. As such, the first small gear

340*c*1 and the second small gear 340*c*2 may rotate in response to a rotation of the large gear 343. Furthermore, the large gear 343 may rotate in response to a rotation of the index spacer 343*a*.

The large gear 343 may have a predetermined amount of teeth (e.g., thirty-three teeth).

Figure 15B:
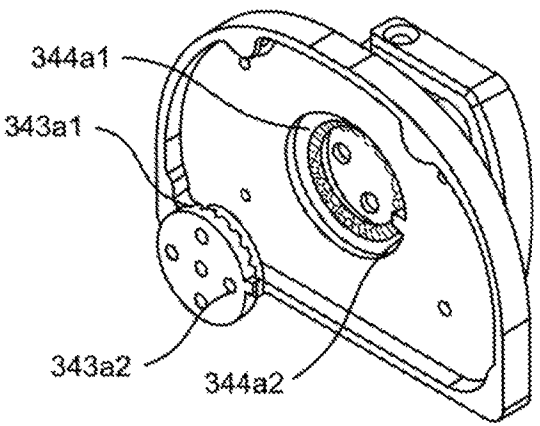
FIG. 15B illustrates a rear perspective view of the dial assembly including an index spacer, according to another exemplary embodiment of the present general inventive concept.
Figure 15C:
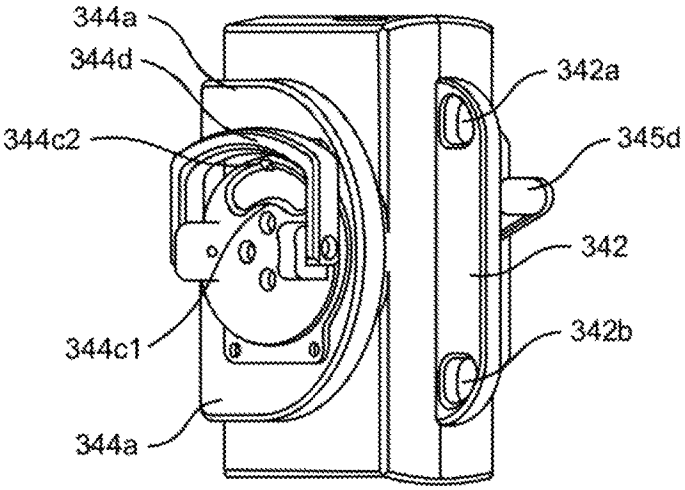
FIG. 15C illustrates a front perspective view of the tensioning assembly including the dial assembly disposed on the tensioning assembly housing, according to another exemplary embodiment of the present general inventive concept.
Figure 15A:
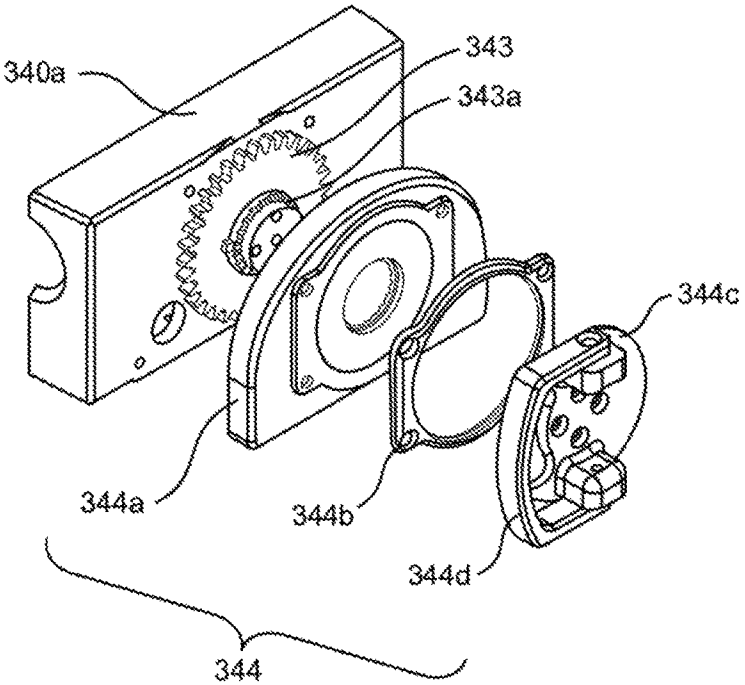
FIG. 15A illustrates a top isometric perspective view of the large gear disposed through a portion of a tensioning assembly housing including an exploded view of a dial assembly, according to another exemplary embodiment of the present general inventive concept.

FIG. 15A illustrates a top isometric perspective view of the large gear 343 disposed through a portion of a tensioning assembly housing 340*a* including an exploded view of a dial assembly 344, according to another exemplary embodiment of the present general inventive concept.

FIG. 15B illustrates a rear perspective view of the dial assembly 344 including the index spacer 343*a*, according to another exemplary embodiment of the present general inventive concept.

The tensioning assembly housing 340*a* may also include, disposed on a front surface thereof, the large gear 343, but is not limited thereto.

Referring to FIGS. 15A through 15B, the large gear 343 may receive thereon the dial assembly 344, specifically, first a number dial 344*a*, then a dial cover 344*b*, then a dial clamp 344*c*, and a dial handle 344*d*. The number dial 344*a* may be affixed and/or adhered to the index spacer 343*a*. Specifically, a plurality of teeth 343*a*1 of the index spacer 343*a* may be connected to a plurality of teeth 344*a*1 on at least a portion of a rear surface of the first number dial 344*a*. Furthermore, a plurality of notches 343*a*2 of the index spacer 343*a* may restrict the dial clamp 344*c* to turn between a plurality of numbers etched on a front surface of the number dial 344*a*.

Moreover, the user may grasp the dial handle 344*d* to rotate the dial clamp 344*c*, which is connected to the index spacer 343*a*, such that turning the dial clamp 344*c* in the first direction or the second direction causes the large gear 343 to turn in the first direction or the second direction, thereby causing the first small gear 340*c*1 and the second small gear 340*c*2 to turn in the first direction or the second direction and either tighten or loosen the two upper surfaces of the pair of tension clamps around the main pole 310.

FIG. 15C illustrates a front perspective view of the tensioning assembly 340 including the dial assembly 344 disposed on the tensioning assembly housing 340*a*, according to another exemplary embodiment of the present general inventive concept.

Referring to FIGS. 15A and 15C, the user may view the plurality of numbers of the number dial 344*a* via the aperture 344*c*1. Moreover, the user may rotate the dial clamp 344*c* to a desired resistance, which is indicated by an arrow 344*c*2 above the aperture 344*c*1. In general, an increase in resistance may be achieved by rotating the dial clamp towards larger numbers.

Figure 16B:
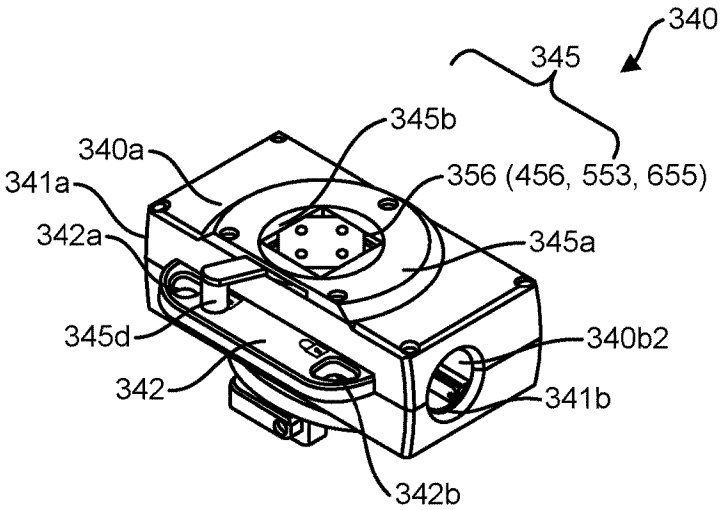
FIG. 16B illustrates a rear isometric view of the handle foot inserted into a handle lock of the tensioning assembly including a handle lock lever in an unlocked position, according to another exemplary embodiment of the present general inventive concept.
Figure 16A:
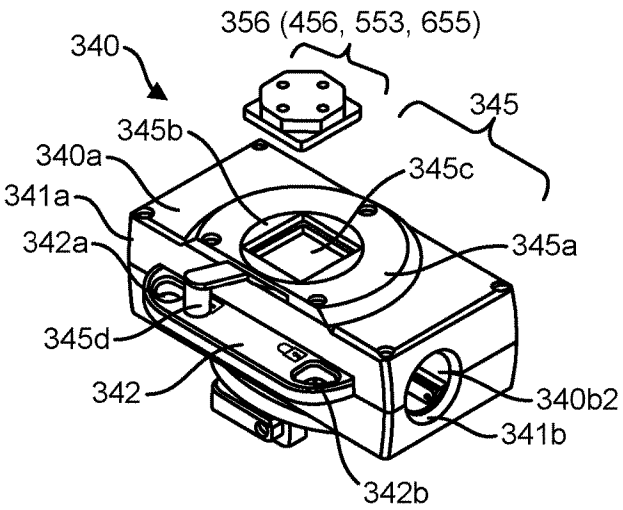
FIG. 16A illustrates a rear isometric view of the tensioning assembly including a handle foot, according to another exemplary embodiment of the present general inventive concept.

FIG. 16A illustrates a rear isometric view of the tensioning assembly 340 including a handle foot 356, according to another exemplary embodiment of the present general inventive concept.

The tensioning assembly housing 340*a* may be disposed around the first tension clamp 340*b*1 and the second tension clamp 340*b*2.

FIG. 16B illustrates a rear isometric view of the handle foot 356 inserted into a handle lock 345 of the tensioning assembly 340 including a handle lock lever 345*d* in an unlocked position, according to another exemplary embodiment of the present general inventive concept.

Figure 16C:
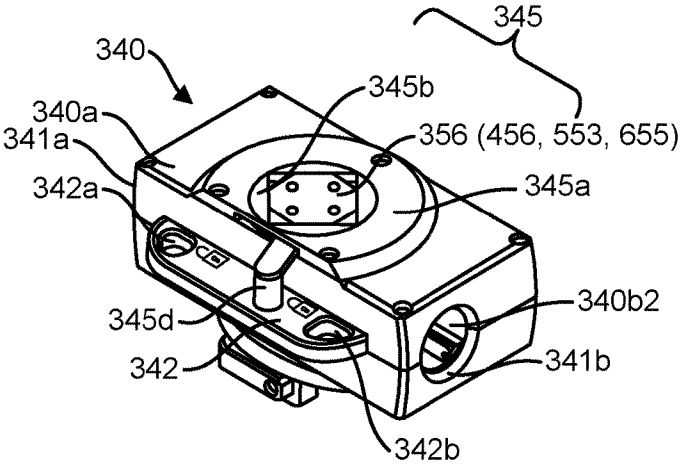
FIG. 16C illustrates a rear isometric view of the handle foot inserted into the handle lock of the tensioning assembly including the handle lock lever in a locked position, according to another exemplary embodiment of the present general inventive concept.

FIG. 16C illustrates a rear isometric view of the handle foot 356 inserted into the handle lock 345 of the tensioning assembly 340 including the handle lock lever 345*d* in a locked position, according to another exemplary embodiment of the present general inventive concept.

Referring to FIGS. 16A through 16C, the tensioning assembly 340 may include the tensioning assembly housing 340*a*, which includes a first pole aperture 341*a* at a first end of the tensioning assembly housing 340*a*, and a second pole aperture 341*b* at a second end of the tensioning assembly housing 340*a*, but is not limited thereto.

As such, an increase in resistance and/or friction is achieved by tightening the tensioning assembly 340 around the main pole 310.

The tensioning assembly 340 may also include a first resistance band anchor loop 342*a* disposed at a first end of a resistance band anchor handle 342, and a second resistance band anchor loop 342*b* disposed at a second end of the resistance band anchor handle 342. The first resistance band anchor loop 342*a* may receive a first end of a resistance band, such that a second end of the resistance band may be attached to the upper resistance band clamp 330. The second resistance band anchor loop 342*b* may receive a first end of another resistance band, such that a second end of the another resistance band may be attached to the lower resistance band clamp 360.

The handle lock 345 may include a protruding portion 345*a*, a rotatable locking member 345*b*, a handle foot-receiving aperture 345*c*, and the handle lock lever 345*d*, but is not limited thereto.

The handle lock 345 may be disposed on a central portion of a rear surface of the tensioning assembly 340. The handle lock lever 345*d* may be disposed within a top portion of the tensioning assembly 340, such that at least a portion of the handle lock lever 345*d* protrudes from a top edge of the tensioning assembly 340.

Figure 17A:
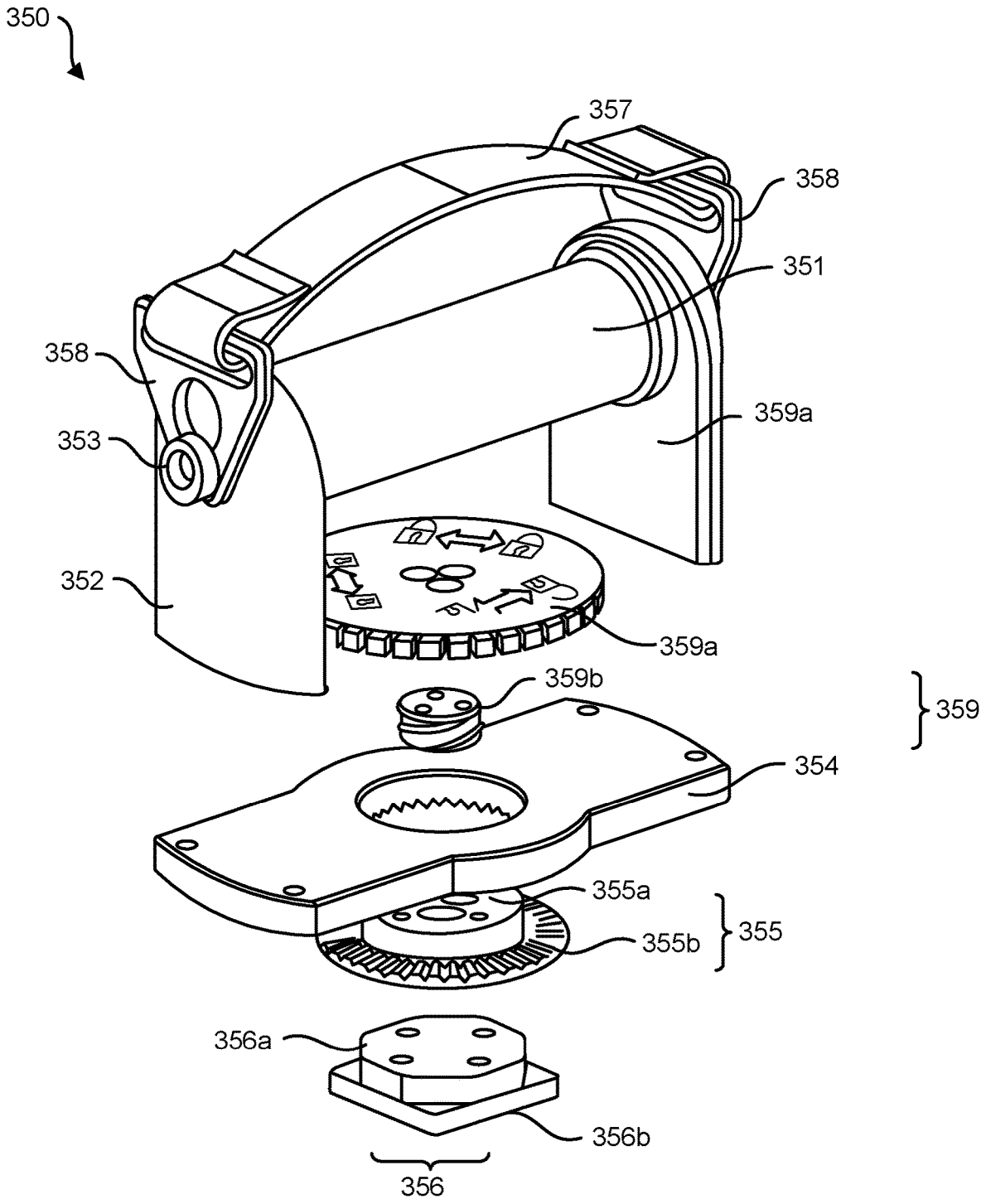
FIG. 17A illustrates a front exploded perspective view of a handle assembly, according to another exemplary embodiment of the present general inventive concept.

FIG. 17A illustrates a front exploded perspective view of a handle assembly 350, according to another exemplary embodiment of the present general inventive concept.

Figure 17B:
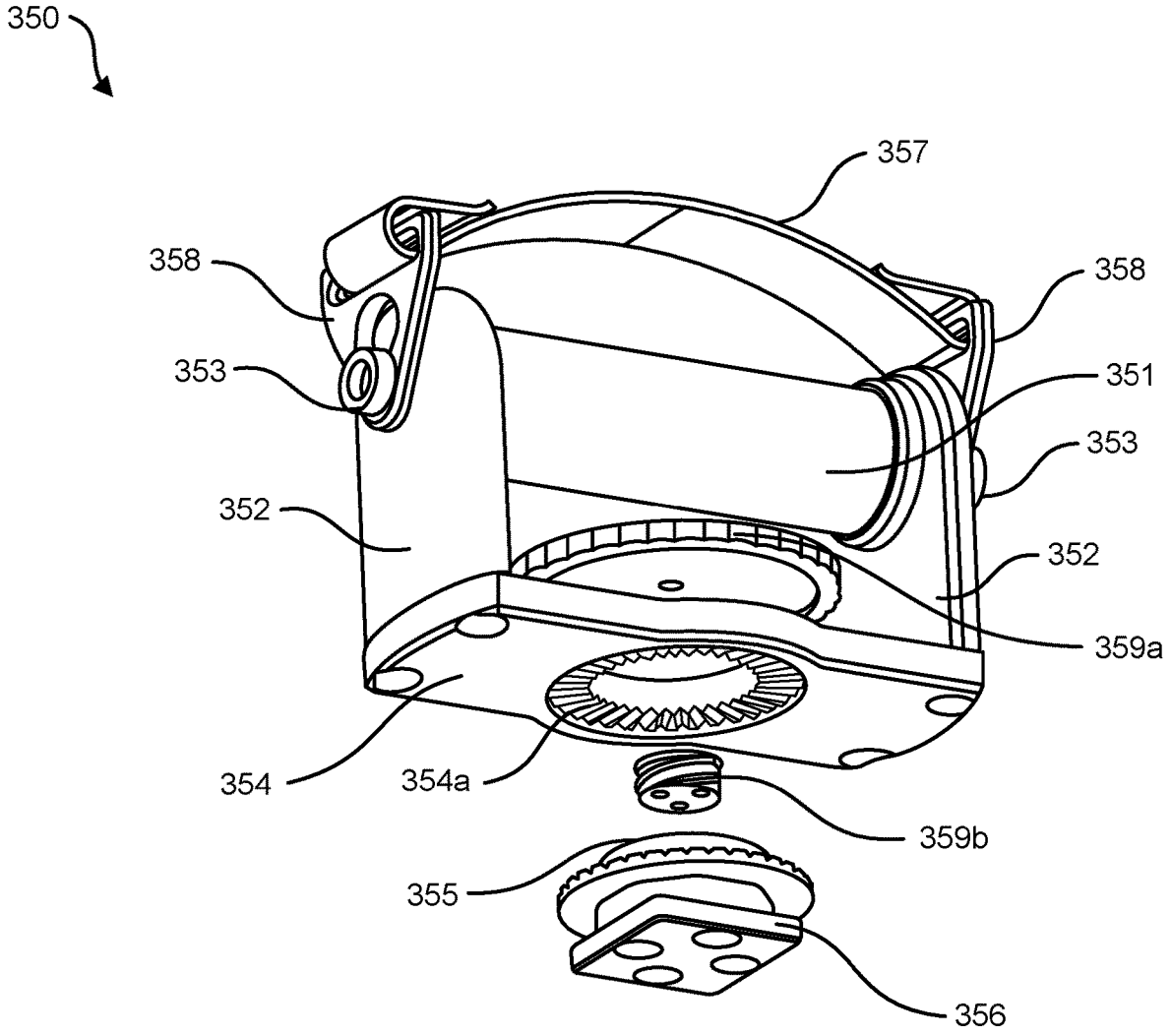
FIG. 17B illustrates a bottom isometric perspective view of the handle assembly, according to another exemplary embodiment of the present general inventive concept.

FIG. 17B illustrates a bottom isometric perspective view of the handle assembly 350, according to another exemplary embodiment of the present general inventive concept.

The handle assembly 350 may include a handle tubing 351, a pair of handle arms 352, a pair of caps 353, a handle base 354, a base pivot 355, the handle foot 356, a tightening strap 357, a pair of removable strap holders 358, and a tightening assembly 359, but is not limited thereto.

The handle foot 356 may include a top portion 356*a* and a bottom portion 356*b*, but is not limited thereto.

The top portion 356*a* is illustrated to have an octagonal prism shape. However, the top portion 356*a* may be a rectangular prism, a pentagonal prism, a hexagonal prism, or any other prism known to one of ordinary skill in the art, but is not limited thereto.

The bottom portion 356*b* is illustrated to have a square prism shape. However, the bottom portion 356*b* may be a rectangular prism, a pentagonal prism, a hexagonal prism, an octagonal prism, or any other prism known to one of ordinary skill in the art, but is not limited thereto.

Referring to FIG. 17B, the handle base 354 may include a plurality of ridges 354*a*, but is not limited thereto.

Referring to FIG. 17A, the base pivot 355 may include a pivot aperture 355*a* and a plurality of ridges 355*b*, but is not limited thereto.

The tightening assembly 359 may include a tightening dial 359*a* and a threaded insert 359*b*, but is not limited thereto.

Referring to FIG. 17A, the handle tubing 351 (preferably at least partially constructed from non-slip material) may be disposed between the pair of handles 352. Additionally, each end of the tightening strap 357 may be disposed through an aperture of each of the pair of removable strap holders 358.

Each of the pair of removable strap holders 358 may be disposed on each of the pair of handle arms 352. Moreover, the pair of removable strap holders 358 may be secured to the pair of handle arms by the pair of caps 353. The pair of handle arms 352 may each be affixed and/or adhered at base portions thereof to the handle base 354, which may be affixed and/or adhered to the protruding portion 345*a* of the handle lock 345 via the handle foot 356, which may be locked to the handle lock 345 using the handle lock lever 345*d*. Furthermore, the tightening dial 359*a* may be affixed and/or adhered to the threaded insert 359*b*, which may be inserted into the pivot aperture 355*a* of the base pivot 355, such that a plurality of threads of the threaded insert 359*b* may interweave with a plurality of threads of the pivot aperture 355*a*. As such, the user may turn the tightening dial 359*a* in a first direction (i.e. clockwise) to tighten the contact between the plurality of ridges 355*b* and the plurality of ridges 354*a*. Also, the user may adjust the orientation of the handle assembly 350 by loosening the tightening dial 359*a* by turning it in a second direction (i.e. counterclockwise), changing the orientation, and turning the tightening dial 359*a* in the first direction.

As such, the handle assembly 350 may be attached to the handle lock 345 of the tensioning assembly 340.

Figure 18:
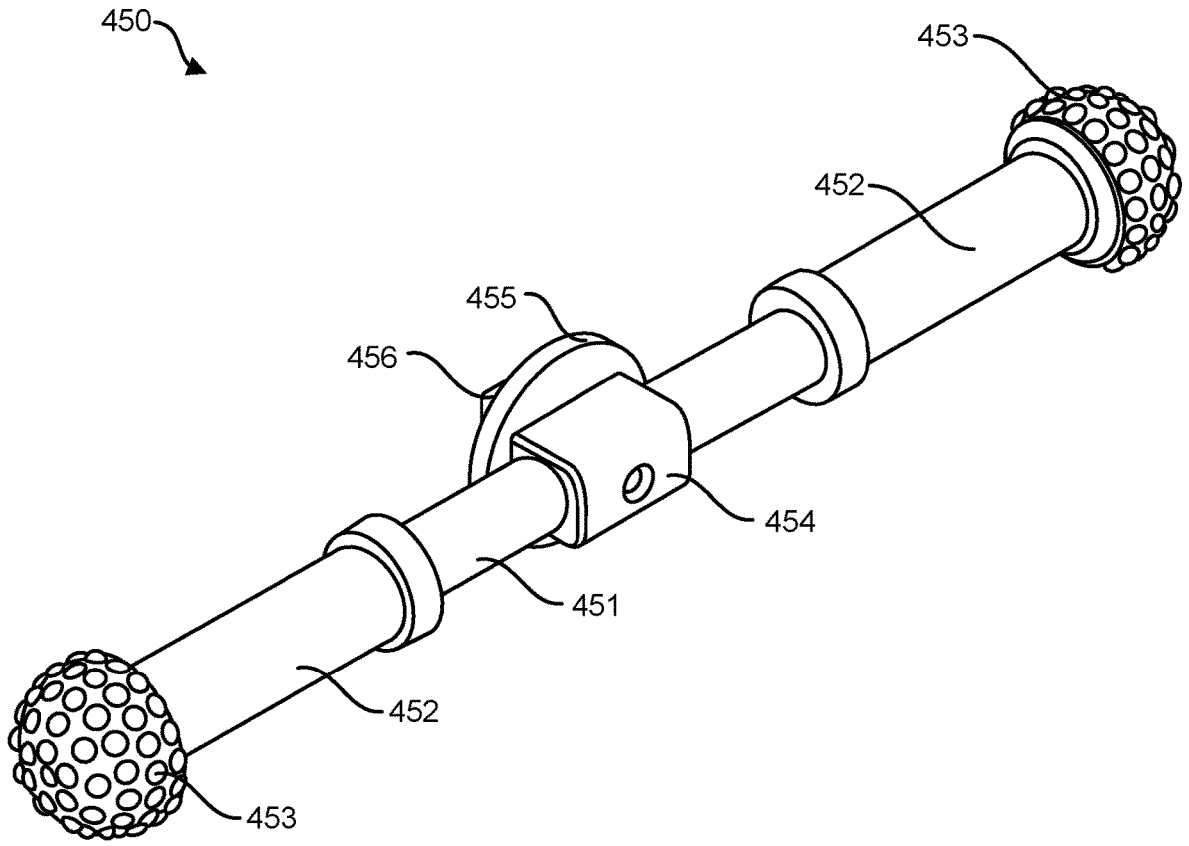
FIG. 18 illustrates a top isometric perspective view of a handle assembly, according to another exemplary embodiment of the present general inventive concept.

FIG. 18 illustrates a top isometric perspective view of a handle assembly 450, according to another exemplary embodiment of the present general inventive concept.

The handle assembly 450 may include a handle tubing 451, a pair of handles 452, a pair of end caps 453, a tube fixture 454, a fixture base 455, and a handle foot 456, but is not limited thereto.

The handle assembly 450 may include a handle tubing 451 may be disposed between the pair of handles 452 (preferably at least partially constructed from non-slip material). Each of the pair of end caps 453 may be disposed on an end of each of the pair of handles 452. The pair of end caps 453 may be soft and textured to improve the user's grip of the handle assembly 450. The handle tubing 451 may be inserted through an aperture of the tube fixture 454, such that the handle tubing 451 protrudes from both ends of the tube fixture 454. The fixture base 455 may be directed toward the handle lock 345. As such, the handle assembly 450 may be attached to the handle lock 345 of the tensioning assembly 340.

Figure 19B:
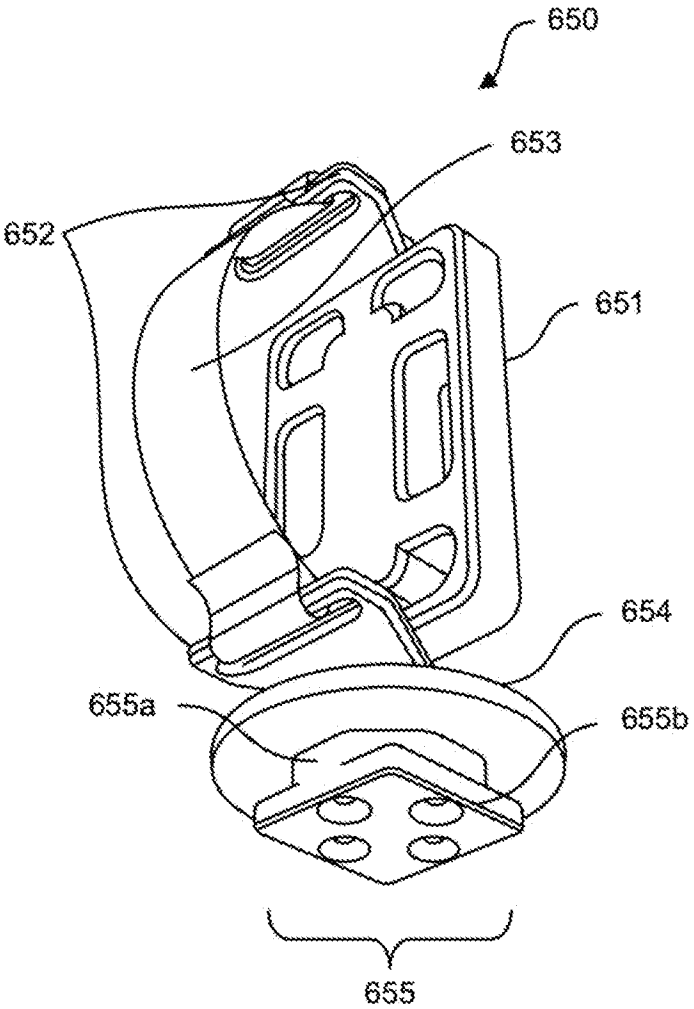
FIG. 19B illustrates a bottom isometric perspective view of a handle assembly, according to another exemplary embodiment of the present general inventive concept.
Figure 19A:
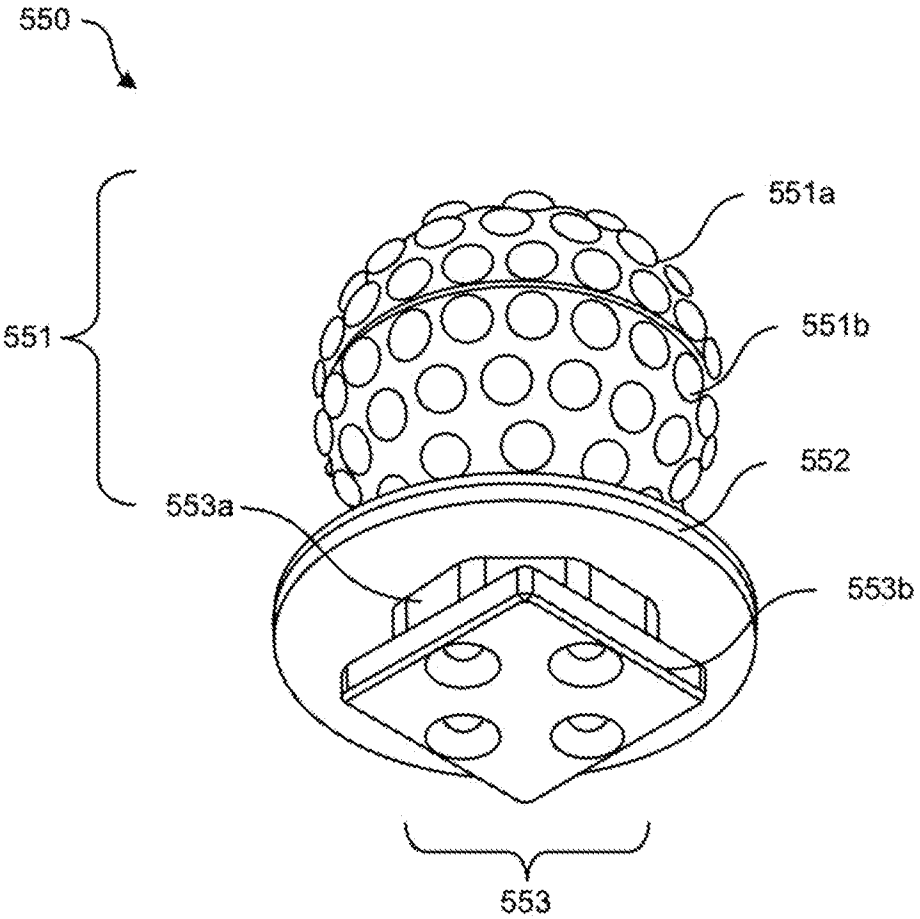
FIG. 19A illustrates a bottom isometric perspective view of a handle assembly, according to another exemplary embodiment of the present general inventive concept.

FIG. 19A illustrates a bottom isometric perspective view of a handle assembly 550, according to another exemplary embodiment of the present general inventive concept.

The handle assembly 550 may include a ball 551, an intermediary surface 552, and a handle foot 553, but is not limited thereto.

The ball 551 may include a first half ball 551*a* and a second half ball 551*b*, but is not limited thereto.

The handle assembly 550 may include a ball 551, which includes a first half ball 551*a* and a second half ball 551*b*, which may have a plurality of rained bumps on surfaces thereof to promote gripping of the ball 551. The second half ball 551*b* may have an intermediary surface 552 disposed on a bottom portion thereof to connect to the top portion 553*a* of the handle foot 553.

The handle foot 553 may include a top portion 553*a* and a bottom portion 553*b*, but is not limited thereto.

The top portion 553*a* is illustrated to have an octagonal prism shape. However, the top portion 553*a* may be a rectangular prism, a pentagonal prism, a hexagonal prism, or any other prism known to one of ordinary skill in the art, but is not limited thereto.

The bottom portion 553*b* is illustrated to have a square prism shape. However, the bottom portion 553*b* may be a rectangular prism, a pentagonal prism, a hexagonal prism, an octagonal prism, or any other prism known to one of ordinary skill in the art, but is not limited thereto.

FIG. 19B illustrates a bottom isometric perspective view of a handle assembly 650, according to another exemplary embodiment of the present general inventive concept.

The handle assembly 650 may include a pedal 651, a pair of strap holders 652, a removable strap 653, an intermediary surface 654, and a handle foot 655, but is not limited thereto.

The handle foot 655 may include a top portion 655*a* and a bottom portion 655*b*, but is not limited thereto.

The top portion 655*a* is illustrated to have an octagonal prism shape. However, the top portion 655*a* may be a rectangular prism, a pentagonal prism, a hexagonal prism, or any other prism known to one of ordinary skill in the art, but is not limited thereto.

The bottom portion 655*b* is illustrated to have a square prism shape. However, the bottom portion 655*b* may be a rectangular prism, a pentagonal prism, a hexagonal prism, an octagonal prism, or any other prism known to one of ordinary skill in the art, but is not limited thereto.

The pedal 651 may be disposed between the pair of strap holders 652. Additionally, each end of the removable strap 653 may be disposed through an aperture of each of the pair of strap holders 652. One of the pair of strap holders may be disposed on a top surface of the intermediary surface 654. Moreover, the pedal 651 may rotate about an axis at the connection between the one of the pair of strap holders 652 and the intermediary surface 654. Furthermore, a bottom surface of the intermediary surface may be disposed on a top surface of the top portion 655*a* of the handle foot 655.

The user may insert a foot onto the pedal 651 to push and/or pull the handle assembly 650.

Referring to FIGS. 17A through 19B, although, not illustrated, the handle foot 456 may be similar in shape, size, and functionality to the handle foot 356, the handle foot 553, and the handle foot 655.

Referring to FIGS. 16B through 19B, the handle foot-receiving aperture 345*c* is illustrated to be square shaped. The bottom portion 356*b* of the handle foot 356 may have a shape to correspond to the handle foot-receiving aperture 345*c*, such as a square prism. As such, the user may insert the handle foot 356 into the handle foot-receiving aperture 345*c*. Alternatively, the user may insert at least one of the handle foot 456, the handle foot 553, and the handle foot 655. The protruding portion 345*a* may be substantially the same height as the handle foot 356 with respect to a rear surface of the tensioning assembly housing 340*a*. Moreover, the rotatable locking member 345*b* (e.g., a rotating surface, a rotating platform) may start in a first position (i.e. unlocked) and rotate 45° to a second position (i.e. locked) in response to the user pushing and/or pulling the handle lock lever 345*d* from the first position to the second position. In other words, the rotatable locking member 345*b* may rotate in response to a manipulation of the handle lock lever 345*d*. As such, the rotatable locking member 345*b* may prevent the handle foot 356 from being removed from the handle foot-receiving aperture 345*c*, when the handle lock lever 345*d* is in the locked position. Specifically, the handle foot-receiving aperture 345*c* may be oriented at a 45° angle relative to the bottom portion 356*b* of the handle foot 356, which may prevent the handle foot 356 from being removed from the handle foot-receiving aperture 345*c*. Conversely, the handle foot 356 may be removed when the handle lock lever 345*d* is in an unlocked position.

Figure 20B:
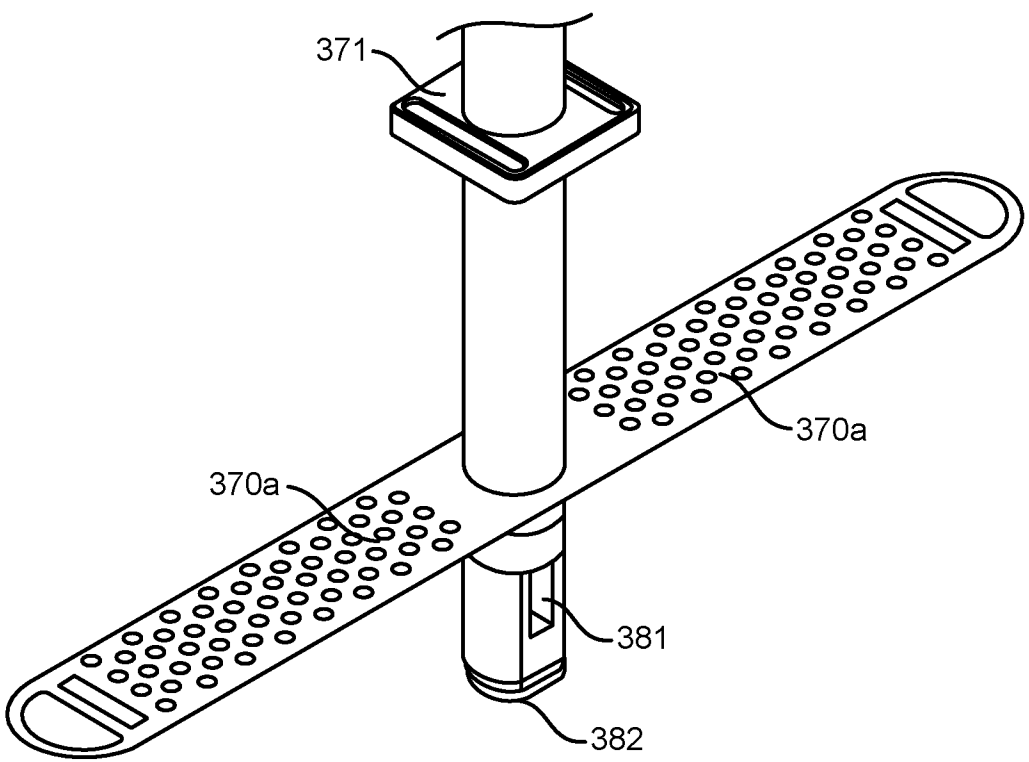
FIG. 20B illustrates a top isometric perspective view of a plurality of foot straps in an extended position, according to another exemplary embodiment of the present general inventive concept.
Figure 20A:
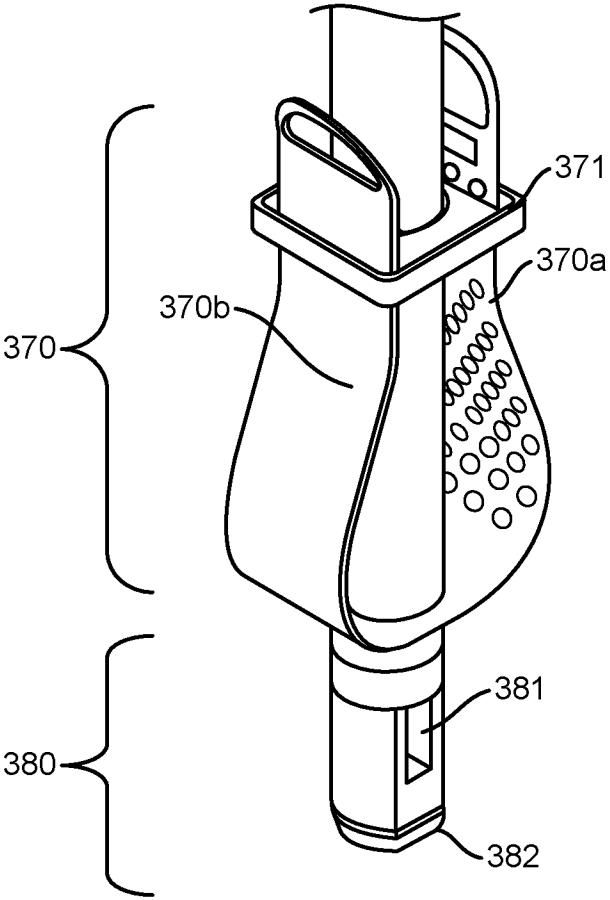
FIG. 20A illustrates a top isometric perspective view of a plurality of foot straps in a folded position, according to another exemplary embodiment of the present general inventive concept.

FIG. 20A illustrates a top isometric perspective view of a plurality of foot straps 370 in a folded position, according to another exemplary embodiment of the present general inventive concept.

FIG. 20B illustrates a top isometric perspective view of a plurality of foot straps 370 in an extended position, according to another exemplary embodiment of the present general inventive concept.

The plurality of foot straps 370 may include a top surface 370*a*, a bottom surface 370*b*, and plurality of foot strap holders 371, but is not limited thereto.

Referring to FIG. 20A, each of the plurality of foot straps 370 may be inserted into each of the plurality of foot strap holders 371. The top surface 370*a* of the plurality of foot straps may be preferably at least partially have a textured surface to increase friction when the user places at least one foot thereupon. Furthermore, the bottom surface 370*b* may be preferably at least partially constructed from non-slip material, such that the plurality of foot straps 370 do not move when the user has at least one foot thereupon.

The base portion 380 may include a base aperture 381 and a base tip 382, but is not limited thereto.

The base portion 380 may support the exercise stick 300 in response to the base tip 382 being in contact with a surface, such that the exercise stick 300 stands perpendicular with respect to the surface. The base tip 382 may be constructed such that the base tip does not cause damage, such as scratching and/or indenting the surface.

Figure 21B:
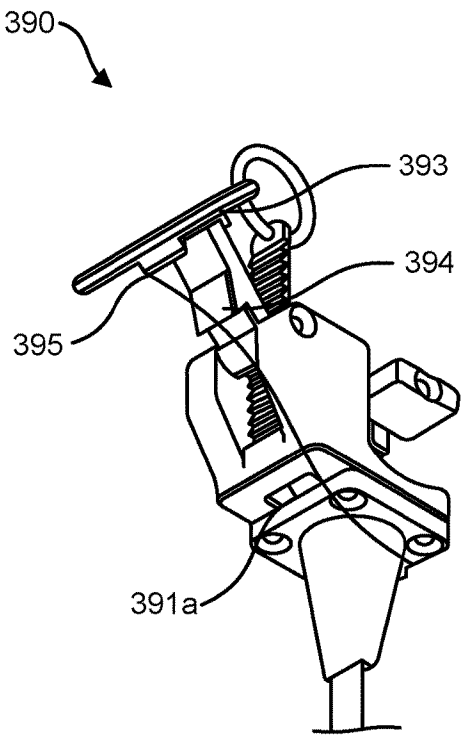
FIG. 21B illustrates a bottom isometric perspective view of the door mount assembly with the ribbon clamp in an open position, according to another exemplary embodiment of the present general inventive concept.
Figure 21A:
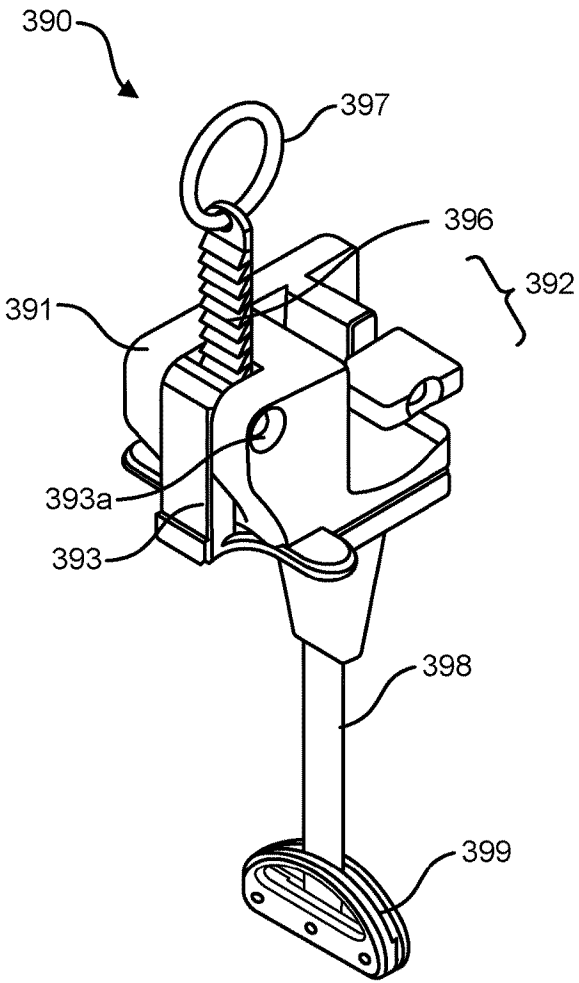
FIG. 21A illustrates a top isometric perspective view of a door mount assembly with a ribbon clamp in a closed position, according to another exemplary embodiment of the present general inventive concept.

FIG. 21A illustrates a top isometric perspective view of a door mount assembly 390 with a ribbon clamp 393 in a closed position, according to another exemplary embodiment of the present general inventive concept.

FIG. 21B illustrates a bottom isometric perspective view of the door mount assembly 390 with the ribbon clamp 393 in an open position, according to another exemplary embodiment of the present general inventive concept.

The door mount assembly 390 may be included in order to position the exercise stick 300 in various horizontal and/or angular positions with respect to the user and/or the floor.

Referring to FIGS. 21A through 21B, the door mount assembly 390 may include a main body 391, a split peg 392, a clamp door 393, a ribbon wedge 394, a clamp wedge 395, a notched ribbon 396, a pull ring 397, a mounting ribbon 398, and a ribbon stop 399, but is not limited thereto.

Referring to FIG. 21B, the main body 391 may include a wedge-receiving groove 391*a*, but is not limited thereto.

The clamp door 393 may include a door hinge 393*a*, but is not limited thereto.

Referring to FIGS. 21A through 21B, the clamp door 393 may be disposed within at least a portion of the main body 391. The pull ring 397 may be disposed on a distal end of the notched ribbon 396 with respect to the main body 391. Additionally, the clamp door 393 may be in a first position (i.e. closed), such that the ribbon wedge 394 catches at least one notch along a front surface of the notched ribbon 396. Specifically, the at least one notch may prevent the notched ribbon 396 from extending in response to the user pushing and/or pulling the pull ring 397. The clamp wedge 395 may be inserted into the wedge-receiving groove 391*a* to prevent the clamp door 393 from opening.

Referring to FIG. 21B, the user may push and/or pull the clamp door 393 to a second position (i.e. open), such that the ribbon wedge 394 is no longer catching the at least one notch along the front surface of the notched ribbon 396. Specifically, the clamp door 393 may pivot about the door hinge 393*a* to reach the second position. As such, the notched ribbon 396 may extend in response to the user pushing and/or pulling the pull ring 397.

At least a portion of the mounting ribbon 398 may be connected to the notched ribbon 396, such that pushing and/or pulling the pull ring 397 may cause both the notched ribbon 396 and the mounting ribbon 398 to move within the main body 391.

The mounting ribbon 398 may be placed between a door and a door jamb, such that the ribbon stop 399 remains on a side of the door opposite of where the user is standing, such that pulling on the exercise stick 300 does not cause the exercise stick to move away from the area between the door and the door jamb.

Figure 22B:
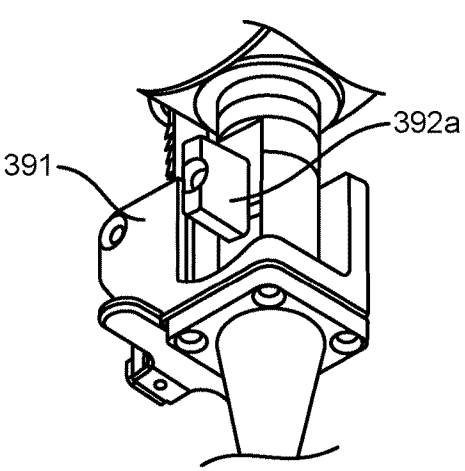
FIG. 22B illustrates a bottom isometric perspective view of the base portion disposed on the door mount assembly with a rotating peg in an unlocked position, according to another exemplary embodiment of the present general inventive concept.
Figure 22C:
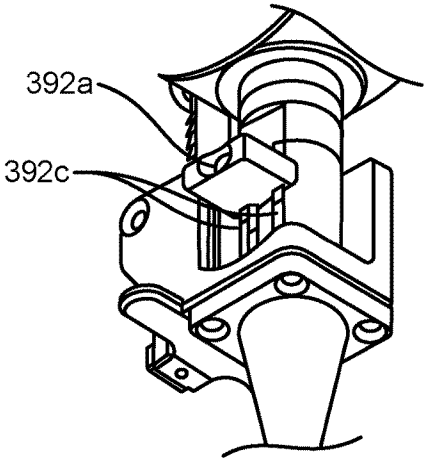
FIG. 22C illustrates a bottom isometric perspective view of the base portion disposed on the door mount assembly with the rotating peg in a locked position, according to another exemplary embodiment of the present general inventive concept.
Figure 22A:
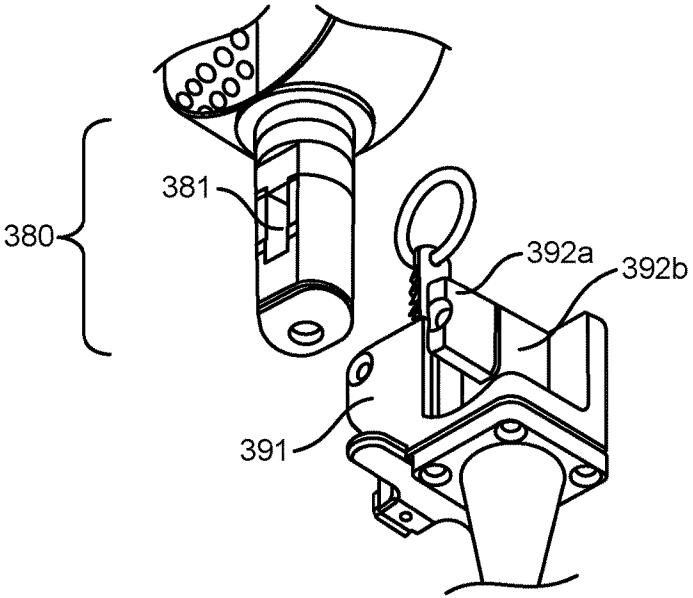
FIG. 22A illustrates a bottom isometric perspective view of the door mount assembly including a base portion, according to another exemplary embodiment of the present general inventive concept.

FIG. 22A illustrates a bottom isometric perspective view of the door mount assembly 390 including the base portion 380, according to another exemplary embodiment of the present general inventive concept.

FIG. 22B illustrates a bottom isometric perspective view of the base portion 380 disposed on the door mount assembly 390 with a rotating peg 392*a* in an unlocked position, according to another exemplary embodiment of the present general inventive concept.

FIG. 22C illustrates a bottom isometric perspective view of the base portion 380 disposed on the door mount assembly 390 with the rotating peg 392*a* in a locked position, according to another exemplary embodiment of the present general inventive concept.

Referring to FIGS. 22A through 22C, the split peg 392 may include a rotating portion 392*a*, a fixed portion 392*b*, and a pair of peg ridges 392*c*, but is not limited thereto.

Referring to FIGS. 22A through 22B, the split peg 392 may be inserted into the base aperture 381 of the base portion 380 of the exercise stick 300, such that the rotating portion 392*a* protrudes from a front side of the base portion 380 and the fixed portion 392*b* is disposed therein. In other words, the base aperture 381 may receive the split peg 392 therein, such that the rotating portion 392*a* protrudes from the front side of the base portion 380 and the fixed portion 392*b* is disposed therein. Additionally, the rotating portion 392*a* may be in a first position (i.e. unlocked).

Referring to FIG. 22C, the rotating portion 392*a* may be rotated in a first direction or a second direction, such that the rotating portion may be in a second position (i.e. locked). The pair of peg ridges 392*c* may prevent the rotating portion 392*a* from movement due to the pair of peg ridges 392*c* catching at least a portion of the rotating portion 392*a*. Subsequently, the user may rotate the rotating portion 392*a*, in the second direction or the first direction, such that the rotating position may be unlocked.

The exercise stick 300 may be used by the user when the user steps on the plurality of foot straps 370, or alternatively, places the mounting ribbon 398 between the door and the door jamb, and then pulls on and/or pushes the handle assembly 350 such that the tensioning assembly 340 may slide along the main pole 310. As stated above, the resistance band(s) may be added between the tensioning assembly 340 and the upper resistance band clamp 330 and/or the lower resistance band clamp 360, in order to provide the user with alternative, additional, and/or optional resistance when sliding the tensioning assembly 340 along the main pole 310. In other words, the upper resistance band clamp 330 and/or the lower resistance band clamp 360 may allow the user to feel alternating muscle groups activated as the user pushes and pulls on the handle assembly 350.

The main purpose of the exercise stick 300 is to provide individuals exercise equipment/a device that requires no weights, bands or springs. The exercise stick 300 provides adjustable resistive force to challenge and strengthen muscles, similar to strengthening encountered from lifting progressively heavier free-weights or by using weighted gym equipment, such as that found in health clubs. As stated above, there is a plethora of scientific studies available that describe physical, psychological, as well as immune-enhancing benefits of resistive exercise. The exercise stick 300 helps individuals partake in an exercise regimen to keep muscles, connective tissue, and bones strong, which are essential to good, long-term health. The exercise stick 300 offers individuals effective strength-training equipment that is light-weight, easy to use, and easy to transport. Furthermore, the exercise stick 300 can be used in the home or virtually anywhere desired, and requires no weights, springs or bands, but may include tension bands for extra resistance if desired. The exercise stick 300 can be used in vertical, horizontal or angular ways, and has a graded resistance available to customize resistive tension for each person and exercise. The exercise stick 300 could prove to be a vital exercise tool for those needing rehab equipment or those who simply want an effective low-cost alternative to gym equipment, club memberships, etc., that is easy to use and travels well.

Of further importance, is that the exercise stick 300 is naturally low-impact and very safe since it uses no heavy weights which have a number of inherent dangers, and requires no bands or springs which can cause injury when unexpectedly breaking or snapping back. Also, users of the exercise stick 300 can stop any movement abruptly with no danger, and they can regulate and select the exercise tension to their preference. They will not risk equipment malfunction or endanger themselves by selecting too high a resistance.

Weights and dumbbells provide long-term progressive resistance exercise, and one can merely select increasingly heavier weights over time to continue to challenge each muscle group. The exercise stick 300 introduces a resilient workout apparatus that individuals can use over many years to exercise, tone and strengthen virtually all arm, leg and core muscles in a progressive fashion similar to that when utilizing free-weights.

Individuals can shorten duration of workout sessions because the exercise stick 300 works the antagonist muscle immediately, in a fraction of a second, after the agonist is worked, with no equipment setup change needed, (for example the bicep is worked immediately following the triceps). This applies to all muscle groups and movements performed with exercise stick 300. Because of its adjustability, the exercise stick 300 can be employed throughout all stages of rehabilitation, and may also be used for long-term exercise and strength-training.

The exercise stick 300 is the only product of its kind to provide a versatile exercise device to assist users at any stage of life, to promote health and well-being. The exercise stick 300 is both a useful rehabilitation tool as well as well as general strengthening equipment. It is uniquely designed to be able to be split into multiple equal parts, offering convenience when transporting or storing. It may also include a padded carrying/storage case to allow for convenient storage and transport of the exercise stick 300, and the case may include separate compartments for storage of all of the components of the exercise stick 300.

The exercise stick 300 may be designed to allow various different muscle groups to be activated during use, based on a change of an angle of the handle assembly 350 with respect to the user. Also, adjustability of the tension of the exercise stick 300 may allow a therapist and a user to monitor and note clear definable strength changes over time and/or over the course of therapy intervention. Changing the tension grade by increasing or decreasing it enables therapists and users to limit, or intensify strengthening. Higher numbers on the number dial 344*a* may indicate the patient is performing at a higher/stronger level (which may be important for documentation purposes of therapists so they may demonstrate a patient's/client's progress, to keep physicians informed or for verifying progress to insurers when submitting for reimbursement, and to justify for an attending physician or payer the appropriateness to continue or stop therapy). In some cases (depending on stage of healing) the physician may want the patient to not overstress a muscle or tendon that they have surgically altered or repaired (for example, tendons have less or greater tensile strength at different stages/times following surgery/repair).

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. An exercise stick, comprising:

a main pole; and a tensioning assembly disposed at a center portion of the main pole to move up the main pole in a first direction toward a first end of the main pole, and to move down the main pole in a second direction toward a second end of the main pole, the tensioning assembly comprising:

a large gear disposed on the tensioning assembly to change a resistance between the tensioning assembly and the main pole in response to a rotation of the large gear, and a plurality of tension clamps connected to opposing sides of the large gear to grip a portion of the main pole, a first worm screw disposed between two upper surfaces of one of the plurality of tension clamps, a second worm screw disposed between another two surfaces of another one of the plurality of tension clamps, a first small gear disposed on an end of the first worm screw to connect to the large gear to rotate the first worm screw in response to rotation of the large gear, and a second small gear disposed on an end of the second worm screw to connect to the large gear to rotate the second worm screw in response to rotation of the large gear, such that the plurality of tension clamps expand or contract in response to rotation of the first worm screw and the second worm screw.

2. The exercise stick of claim 1, wherein the resistance between the tensioning assembly and the main pole increases or decreases based on tightening of the first worm screw and the second worm screw within the tensioning assembly, to cause the tensioning assembly to move more easily along the main pole based on a loosening of the first worm screw and the second worm screw or more difficultly along the main pole based on a tightening of the first worm screw and the second worm screw.

3. The exercise stick of claim 1, further comprising:

a handle assembly attached to the tensioning assembly to allow a user to move the tensioning assembly in the first direction and the second direction.

4. The exercise stick of claim 3, wherein the handle assembly comprises:

a handle foot to attach to the tensioning assembly.

5. The exercise stick of claim 4, wherein the tensioning assembly further comprises:

a handle lock disposed within a central portion of a rear surface to receive the handle foot.

6. The exercise stick of claim 5, wherein the handle lock comprises:

a handle lock lever disposed within a top portion of the tensioning assembly to lock or unlock the handle foot within the handle lock; and a rotatable locking member disposed within a central portion of the handle lock to rotate in response to a manipulation of the handle lock lever, such that the handle foot is removable in an unlocked position and not removable in a locked position.

7. An exercise stick, comprising:

a main pole; and a tensioning assembly disposed at a center portion of the main pole to move up the main pole in a first direction toward a first end of the main pole, and to move down the main pole in a second direction toward a second end of the main pole, the tensioning assembly comprising:

a large gear disposed on the tensioning assembly to change a resistance between the tensioning assembly and the main pole in response to a rotation of the large gear, a first tension clamp having a first small gear connected to a first worm screw, the first tension clamp disposed within an inner portion of the tensioning assembly to grip a portion of the main pole, such that two upper surfaces of the first tension clamp open or close in response to a rotation of the first small gear, and a second tension clamp having a second small gear connected to a second worm screw, the second tension clamp disposed within the inner portion of the tensioning assembly to grip a portion of the main pole, such that two upper surfaces of the second tension clamp open or close in response to a rotation of the second small gear, wherein the large gear is rotatably connected to the first small gear and the second small gear to control the rotation of the first small gear and the second small gear.

* * * * *